US005551802A

United States Patent [19]

Wybro

[11] Patent Number: 5,551,802

[45] **Date of Patent: * Sep. 3, 1996**

[54] TENSION LEG PLATFORM AND METHOD OF INSTALLATION THEREFOR

[75] Inventor: Pieter G. Wybro, Houston, Tex.

[73] Assignee: Sea Engineering Associates, Inc., Houston, Tex.

[ * ] Notice: The portion of the term of this patent subsequent to Feb. 8, 2013, has been disclaimed.

[21] Appl. No.: 186,901

[22] Filed: Jan. 25, 1994

Related U.S. Application Data

[63] Continuation-in-part of Ser. No. 14,690, Feb. 8, 1993, Pat. No. 5,421,676.

[51] Int. Cl.[6] ..... B63B 35/44; E02B 17/00

[52] U.S. Cl. ..... 405/223.1; 405/204; 405/209; 405/224

[58] Field of Search ..... 405/195.1, 223.1, 405/224, 202, 203, 204, 227; 114/265, 264, 294; 166/350, 359, 367; 175/7

[56] References Cited

U.S. PATENT DOCUMENTS

| | | | |
|---|---|---|---|
| 4,281,613 | 8/1981 | Ray et al. | 114/230 |
| 4,626,136 | 12/1986 | Gunderson | 405/224 |
| 4,626,137 | 12/1986 | Willemsz | 405/224 |
| 4,636,114 | 1/1987 | Hale | 405/224 |
| 4,702,321 | 10/1987 | Horton | 405/224 X |
| 4,702,648 | 10/1987 | Stageboe et al. | 405/224 |
| 4,762,180 | 8/1988 | Wybro et al. | 166/350 |
| 4,780,026 | 10/1988 | Gunderson | 405/224 |

(List continued on next page.)

FOREIGN PATENT DOCUMENTS 2040599 1/1971 France .

OTHER PUBLICATIONS

Article By McCabe, "New Production Concept For Deepwater Gulf of Mexico", Sep. 1992, Ocean Industry Magazine p. 128.

Article By Wybro, "Near–Surface Completions Improve Economics" (Part 1) Mar. 1992, Ocean Industry Magazine, p. 45.

Article By Wybro, "Near–Surface Completions Improve Economics" (Part 2) Apr./May 1992, Ocean Industry, p. 38.

Article, "Minimum TLP Targets 17 Million Boe Pools in Deepwater", Sep. 1993, Offshore/Oilman magazine, p. 17.

Offshore Technology Conference Paper #6360 by Hunter et al, "Designating the TLWP", May 1989.

*Primary Examiner*—Dennis L. Taylor

*Attorney, Agent, or Firm*—Kenneth A. Roddy

[57] ABSTRACT

An offshore tension leg platform having a deck, a hull, and a plurality of elongate tendons securing the hull to an ocean floor foundation provides full well workover and production capabilities for autonomous operation and can be installed and operated in any water depth and sustains any environmental loading conditions. The hull supports well risers of well trees located below the water surface at an elevation in close proximity to the connections of the tendons to the hull. Alternatively the risers and trees may be supported above water by a deck or the trees may be located on the seabed. A workover platform supported by a perimeter trackway on the deck may be positioned over any of the well risers for workover operations. Liquid products may be exported from the platform via a pipeline or to a floating tanker. The hull is configured to minimize loadings in the tendons. All components are installed by a drilling vessel without the need for special installation vessels and equipment. The tendons are arranged in groups offset from the hull body to resist platform overturning loadings, and to reduce the tendons pretension required to prevent platform pitch and roll motions. The wells are drilled prior to installation of the hull using a drilling vessel. After installation of the platform, all operations required on the wells are performed autonomously from the platform and additional wells can be drilled by offsetting the platform and locating a floating drilling rig over the well to be drilled.

29 Claims, 20 Drawing Sheets

U.S. PATENT DOCUMENTS

| | | | |
|---|---|---|---|
| 4,784,528 | 11/1988 | Hunter | 405/227 |
| 4,784,529 | 11/1988 | Hunter | 405/224 X |
| 4,848,970 | 7/1989 | Hunter et al. | 405/224 |
| 4,861,196 | 8/1989 | Folse | 405/224 |
| 4,895,481 | 1/1990 | Pepin-Lehalleur et al. | 405/224 |
| 4,913,238 | 4/1990 | Danazcko | 166/350 |
| 4,966,495 | 10/1990 | Goldman | 405/224 |
| 4,995,762 | 2/1991 | Goldman | 405/185 |
| 5,150,987 | 9/1992 | White et al. | 405/224 |
| 5,174,687 | 12/1992 | Dunlop et al. | 405/223.1 |
| 5,190,411 | 3/1993 | Huete et al. | 405/223.1 |

TENSION LEG PLATFORM AND METHOD OF INSTALLATION THEREFOR

CROSS REFERENCE TO RELATED APPLICATION

This Application is a continuation-in-part of U.S. patent application Ser. No. 08/014,690, Filed Feb. 8, 1993, now U.S. Pat. No. 5,421,676.

BACKGROUND OF THE INVENTION

1. Field of the Invention

This invention relates generally to tension leg platforms, and more particularly to an offshore tension leg platform (TLP) and a method for installing the same at a deepwater location.

2. Brief Description of the Prior Art

In the past, tension leg platforms (TLP's) have been designed to include the capability of performing well drilling operations. These platforms have supported the risers and well trees at the deck level. To meet these requirements, the platforms have to be large enough to provide buoyancy to support the payload of the well drilling equipment and the risers support system has to incorporate mechanisms which ensure the tension in each riser remains constant as the length of the risers varies due to movements of the hull caused by wave and environmental loadings. The size and complexity of these TLP's have resulted in costs which are too high for the commercial development of small offshore hydrocarbon reservoirs.

In the search for a means of producing from small reservoirs, various small TLP configurations have been proposed including TLP's without any drilling capability. All post-installation drilling activities have to be performed by a drilling vessel positioned alongside or over the TLP. The purpose of these platforms has been only to support the risers and position the well trees above the water surface. Production equipment and facilities have been provided on the separate drilling and support vessel, such as disclosed in U.S. Pat. No. 4,913,238 to Danazcko et al and U.S. Pat. No. 5,190,411 to Huete et al.

Other proposed small TLP's have included the provision of production facilities such as in U.S. Pat. No. 5,117,914 to Blandford. However, no capability for platform supported wells or well intervention operations has been included. In summary, all the proposed small TLP's have a requirement for a separate vessel in order that operations can be performed on the wells during the phase of producing from the reservoir.

The present invention provides all well intervention capabilities for production well completions, re-completions, workover and fluid injection operations. The technical complexity of the large TLP's is, however, avoided by minimizing the above water payload. Moreover the configuration of the platform hull reduces the loadings and thereby reduces the loadings in the anchored tendons. Furthermore, the placement of the well riser support mechanisms at a strategic position below the water surface simplifies the risers support mechanisms. Installation of the foundations, tendons and hull does not require a specialist deepwater cranevessel and equipment.

A tension leg platform of the prior art is described in U.S. Pat. No. 4,784,529 (Hunter), and Offshore Technology Conference Paper No. 6360 (1990) by Hunter et al. A drilling template seabed structure is generally provided to position and support the production wells, and this structure is, in turn, supported by piles. The template includes means by which the structure's elevation and inclination may be adjusted. A separate seabed foundation structure or structures are provided to anchor the platform. The foundation structure is secured to the seabed by steel tubular piles. These are too large to be installed by a conventional drilling vessel and equipment and in the past have been driven into the soil using specialist pile hammers, which in turn can only be operated by specially equipped installation vessels. The anchor piles are permanently connected to the foundation structure(s) by grout or mechanical means. The tendons are connected to the foundation structure(s) and not to the anchor piles. To sustain the imposed loadings, the tubular steel tendons are manufactured with high technology materials and assembly procedures. They have been either assembled ashore as complete units or sections have been jointed at site using specialist connectors and handling equipment. In both cases, special means, vessels and procedures must be used for the transportation and installation of tendons at site. To resist high fatigue loadings at the tendon connections special complex flex joint means are provided for freedom of rotation and to sustain cyclic loading variations. To support the high tendon pre-load tensions, the large deck, full well drilling facilities and the deck-supported well risers and trees, the hull is configured with large multiple (typically four) vertical corner columns which are joined by submerged pontoon elements (typically four). The resistance of the large columns to environmental loadings results in the need for higher tendon tensions to prevent pitching and rolling and heaving motions of the platform. Similarly, the larger waterplane area of the columns results in higher heave, pitch and roll induced loadings in the tendons.

In order to perform drilling operations on a well, the drilling rig is located directly above the seabed wellhead. On prior art tension leg platforms, this requirement has been fulfilled in one of two ways. The rig is movable and is positioned as desired on the platform deck. The movement of the large well drilling rig and the associated large variable load has to be accompanied by adjustment of the hull water ballast placement in order that tension forces in each of the tendons remain within limits. This requirement to adjust the volume and location of hull water ballast in turn means that the submerged portion of the hull must be large enough to provide corresponding excess volume and ballast position flexibility. The alternative means of positioning the rig without adjustment of the hull water ballast is to change the plan position of the hull with respect to the subsea wellheads. Means of positioning the hull which have been proposed are either by providing a platform mooring system and adjusting the lengths of the mooring lines to move the platform to the desired position, or by equipping the hull with thrusters which offset the hull to a desired horizontal position and thereafter maintains the position while operations are performed on a given well. Both alternatives require additional platform means and complexities which increase the weight which, in turn, increases the size of the hull, tendons and anchor foundations and increase the cost.

The drilling structure on the TLP deck is used to support not only drilling operations, but other well intervention operations such as well workovers. The drilling rig structure will be subjected to external loadings due not only to the wind loadings but also due to the horizontal acceleration of the platform. These lateral acceleration loadings can be large when significant tubular setback is placed inside the derrick of the drilling rig, and an extreme storm condition is experienced which produces large accelerations. The drilling structure therefore must withstand these dynamic loadings and this may require the rig to be a special design.

Prior art tension leg platforms support the well risers at the deck where the trees are located and the deck structure must therefore be strengthened to support the risers and transmit the payload to the columns of the hull, and the resulting increased weight of the deck results in an increase in the size of the supporting hull. The tendons, however, are connected at the optimum elevation at or close to the keel of the hull. When the platform is subjected to horizontal environmental loadings of wind, waves and current, the resulting forces push the hull sideways. However, since the hull is restrained vertically by the anchored tendons, the horizontal offset movement is accompanied by a corresponding downward vertical movement. This increase of the hull draft, or "platform setdown", causes the elevation of the tops of the well risers to be changed with respect to the elevation of the deck, and the tension loads in the riser must remain constant within defined limits. The changes in the riser lengths are caused by the difference in the distance between the bottom and the top points of connection of the tendons and the risers. In order to prevent undue tension variations of the risers these are suspended from the platform deck with variable stroke, constant tension devices. This equipment increases the platform complexity; and due to its weight, the size of the submerged portion of the hull must be increased to provide support for this payload.

A basic feature of the tension leg platform concept is that within prescribed limitations, the pretension loading in each tendon must be equal. Prior art platforms have incorporated complex means for adjusting the effective length and pretension of each tendon during the installation operations of connecting the tendons to the hull, as shown in U.S. Pat. Nos. 4,281,613 (Gunderson), 4,848,970 (Hunter, et.al.), 4,784,529 (Hunter) and 4,780,026 (Gunderson).

Prior art relating to TLP platform installation have relied on various special installation equipment and systems, such as crane vessels, which are expensive to operate in deep water. Also, prior TLP platform installations have used several different installation spreads for the various phases of installation of templates, foundations, tendons, hulls, and well drilling. This has required the expensive and time consuming mobilization and demobilization of various equipment.

SUMMARY OF THE INVENTION

It is therefore a general object of the present invention to provide an offshore tension leg platform and method of installation and operation which will obviate or minimize the complexities and overcome the limitations of conventional tension leg platforms thereby reducing the cost of the platform and of producing from small offshore reservoirs.

It is another object of the present invention to provide a tension leg platform which may be used not only for production from small deepwater offshore reservoirs but also, by installing multiple platforms allows a phased development of the production from medium and large reservoirs.

It is another object of the present invention to provide a seabed structure which will position the wells and anchor piles in a desired arrangement. The structure may be installed by a conventional deepwater drilling vessel and using normal drilling equipment. The seabed structure does not constitute a structurally integral part of the installed platform structure.

It is another object of the present invention to provide a tension leg platform installation method wherein the foundation anchor piles are installed using conventional drilling techniques and each tendon is connected to a designated pile, and the anchor piles may be installed prior to, during or after the operations of drilling the production wells.

It is another object of the present invention to provide a tension leg platform wherein the tendons may be manufactured using standard oil industry drilling materials and components and may be assembled and installed by a conventional deepwater drilling vessel.

It is another object of this invention to provide a tension leg platform wherein each tendon is connected to a foundation pile using a tapered stress joint of varying diameter and the tendon and pile may be assembled and installed as a single unit, and wherein all the platform tendons are installed and connected to the foundation anchor piles before the hull structure is towed to the site.

It is another object of this invention to provide a tension leg platform having a hull structure that is configured to minimize the magnitude of the loadings in the tendons, thereby minimizing the size and complexity of the anchor piles, the connections between the piles and tendons, the tendon bodies and the connections of the tendons to the platform hull.

It is another object of this invention to provide a tension leg platform having a hull structure sufficiently small and simple such that it may be manufactured by the majority of the fabrication facilities which provide such services to the offshore energy industry and may be towed, floating, by a conventional towing vessel from the site of manufacture to the offshore designated platform location and connected to the tendons without any need for auxiliary buoyancy elements or cranevessel lifting assistance, and wherein connection of the hull to the tendons is performed simultaneously on the full complement of tendons without the need for complex tensioning devices, and other mechanisms previously required for installing TLP tendons.

Another object of this invention is to provide a tension leg platform which supports the well risers near the keel of the hull at an elevation close to that of the tendon upper connections so that the well trees can be located below the water surface directly above riser support means, or above the water surface, wherein the means of riser support is maintenance free and devoid of any hydraulic or hydropneumatic mechanisms, and the well trees comprise conventional above-water surface components and are devoid of complex fixtures and controls that are normally used for subsea trees.

Another object of this invention is to provide a tension leg platform wherein the platform above surface equipment and facilities are capable of supporting production and well workover operations, as normally encountered with the exception of actual drilling of the wells, and if so desired, may have equipment and facilities which permit the transfer of fluid products to a floating tanker vessel for exportation from the site, or by means of a conventional pipeline, and may be equipped with a means of mooring the tanker, if such means is used.

Another object of this invention is to provide a tension leg platform wherein standardly available well workover and intervention equipment can be used for well intervention and the equipment does not require specific design.

It is another object of this invention to provide a tension leg platform installation method wherein all operations involving the installation of the system and the drilling of the wells can be performed with the drilling rig, to permit more efficient and less costly installation.

It is a further object of this invention to provide a tension leg platform wherein the major portion of the platform components may be used again at a different site including the deck, all equipment there on, the hull, the risers and well trees and the tendons.

BRIEF SUMMARY OF THE PREFERRED EMBODIMENT

A preferred embodiment of the invention, which is intended to accomplish all the foregoing objects, entails a small tension leg platform which is manufactured using existing materials, components and technology already used in the offshore industry and which may be installed using a conventional deepwater drilling vessel. A conventional cranevessel may be used to install the deck structure, fully equipped, by lifting the single unit and setting it onto the hull structure, after the hull has been connected to the tendons.

A template structure manufactured using steel plate and tubulars is installed on the seabed. This serves to position the required number of wells and anchor piles in their desired positions. The wells and anchor piles, when completed, are supported by the subsoil alone, there being no requirement for permanent support by the template. The template structure is devoid of any mechanisms for adjustment of elevation or horizontal trim. Two alternative means of supporting the structure exist. For seabed soil conditions which are suitable, the template is supported by the seabed surface. Areas of steel plate panels are provided to distribute the payload of the template over the seabed. When the load carrying capacity of the seabed is insufficient or surface is irregular, piles are provided to support the template structure independent of the seabed surface. A steel frame is placed on the seabed. This serves to position the support steel tubular piles as desired. The frame and piles are installed using a drilling vessel and conventional drilling equipment and practices. The same vessel is then used to lower and emplace the template structure onto the support piles.

A tubular steel foundation anchor pile is provided for each of the platform tendons. These piles are installed using traditional drilling practices.

A desired number of tendons are provided to connect the hull to the foundation anchor piles. The main body of the tendon comprises standard casing pipe sections as used in wells, which are assembled at site by a drilling vessel using conventional equipment and practices. The lower extremity of the tendon is connected to the anchor pile with tapered stress joint of varying section. The tendon connection to the hull structure consists of a short tubular steel pipe section which is attached to the main tendon body with a stress joint similar to that used on the lower extremity. Alternatively, a flex joint or a cardan type joint may also be used at the top tendon connection. The upper pipe section is inserted into a corresponding pipe sleeve of larger diameter which is attached near the base of the hull by steel bracing members. Cement grout pumped into the annulus between the connecting tendon pipe and the hull sleeve pipe provides a permanent connection of the tendon to the hull.

A drilling vessel is used to assemble and deploy each anchor pile and tendon assembly vertically from the rig. All the tendons are installed, anchored by the foundation piles, before the hull structure is towed to the site. Temporary buoyancy units are provided and attached to the tendons near the upper extremity. These provide an upward force on the tendon and maintain it in tension and with a vertical attitude when not subjected to horizontal environmental loadings.

The hull is positioned, floating directly above the installed tendons by a combination of hawser lines from the drilling vessel to the hull, and towlines attached from the hull to assisting tugboats. Temporary winch controlled tension lines are connected to each of the tendon upper extremities and the hull is then ballasted with water so that the connection sleeves engage over the tendon tops. The water ballast is increased until the tendon connectors are each inserted inside the respective hull connection sleeves, and the desired draft is reached. The hull is then deballasted a prescribed amount, and means are provided on each connection sleeve to prevent relative movement of the hull and the tendons during the placement and curing of the permanent cement grout connection material, said means being a mechanical gripper unit on each tendon receptacle sleeve which when activated engage upon the tension line such that the hull is permitted to travel downward with respect to the tension line but is restrained from upward relative movement.

The hull upper section comprises a plurality of vertical columns which passes through the water surface, up to an elevation above the general height of waves. Structural bracing connects the various column elements, and provide a rigid support structure. The platform deck structure is supported by the columns. The hull and deck structure, with equipment, can be fabricated together prior to towout to site. Alternately, the hull can be fabricated without the deck structure, towed to site, connected to the tendons, and then the complete equipped deck is lifted by a conventional crane vessel off a cargo barge and placed onto the hull. The hull and deck joint is then welded for a permanent structural connection.

The wells can be pre-drilled and either temporarily plugged and abandoned, or completed and suitably plugged. In either case, all operations can be performed by a mobile drilling vessel prior to installation of the platform at the site. Alternately, some of the wells can be pre-drilled by the drilling vessel, and additional wells can be drilled after the platform is installed by offsetting the platform by suitable means to one side, then positioning a mobile drilling unit over the well location. After the wells are drilled, they are temporarily plugged, the mobile rig is removed, and the platform is returned to its upright position.

The wells are completed by lowering and connecting a tubular riser to each wellhead positioned approximately directly below the platform. This riser is supported by tensioner devices at an elevation that is substantially the same as the elevation of the connection of the tendons to the hull. The tensioner devices provide support tension and allow for the riser to stroke relative to the hull. The trees are then connected to the top of the riser. Well tubing is run in the inside of the riser, providing a flow path for the produced well fluids.

The risers, well tubing, trees and other well equipment are deployed by a skiddable workover structure which supports well workover equipment. The workover structure supports not only the workover equipment, but also supports the well tubulars vertically oriented, in a setback area, thereby the well workover equipment does not have dynamic loadings, and can be standardly available.

BRIEF DESCRIPTION OF THE DRAWINGS

Other objects and advantages of the present invention will become apparent from the following detailed description of preferred embodiments thereof taken in conjunction with the accompanying drawings wherein.

DESCRIPTION OF THE PREFERRED EMBODIMENT

Figure 1:
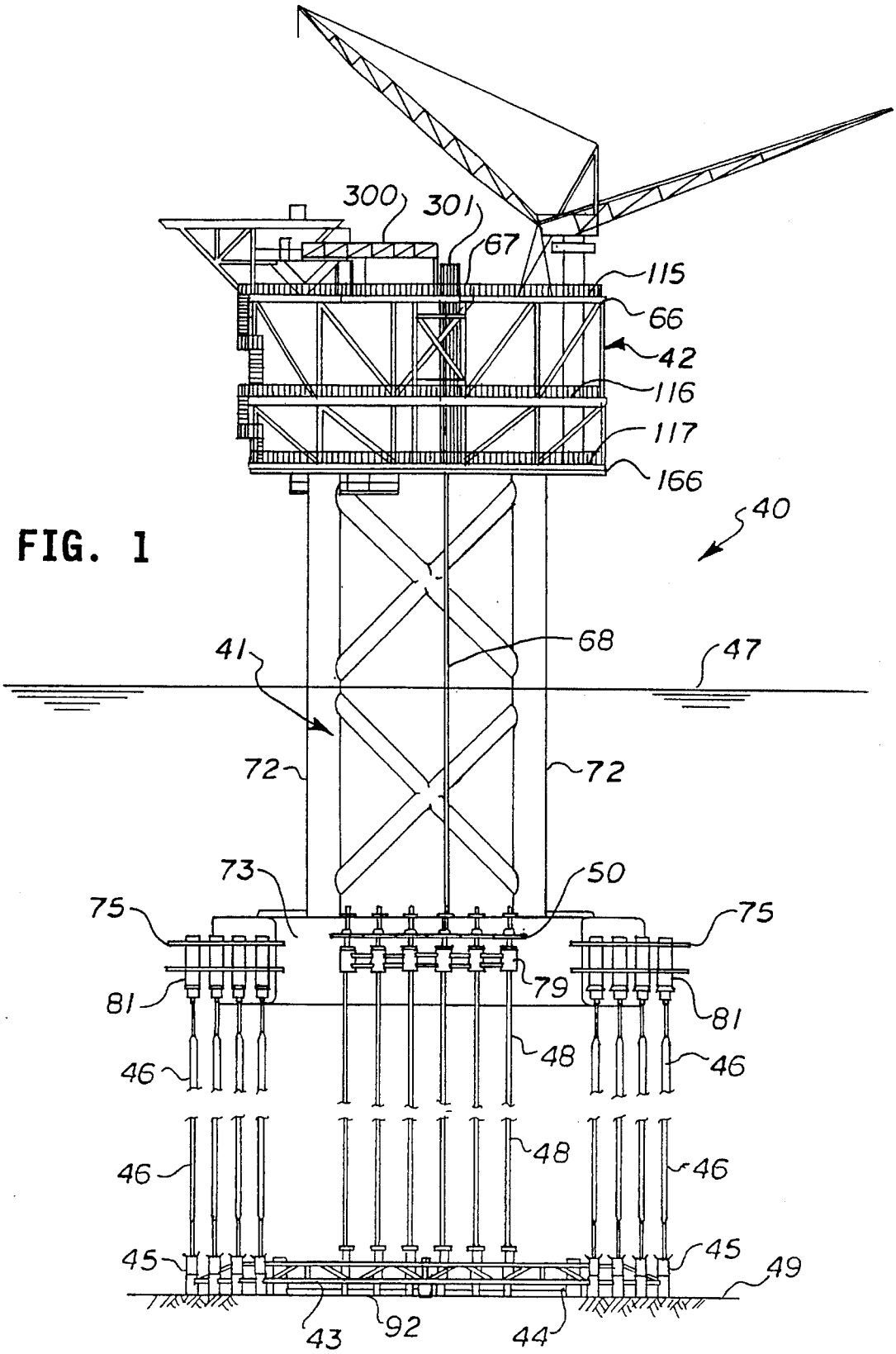
FIG. 1 is a side elevational view of a tension leg platform for offshore well workover and/or production operations in accordance with a preferred embodiment of the invention.
Figure 3:
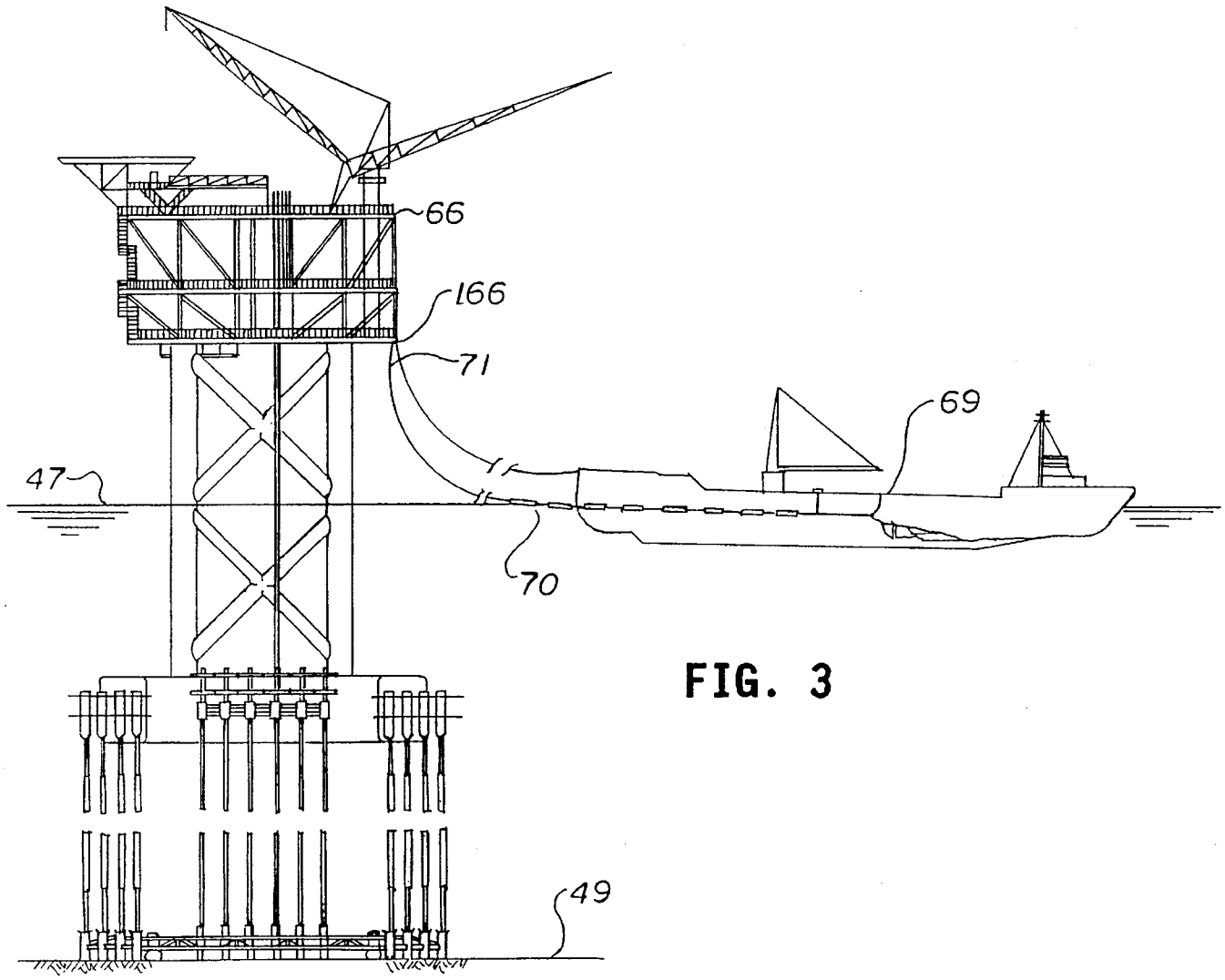
FIG. 3 is a side elevational view of the platform with a tanker or a tank barge moored to the platform and with product export loading hose connected from the platform to the tanker.

Referring now to the drawings, in FIG. 1, there is shown an elevation view representation of an offshore tension leg production platform 40 in accordance with a preferred embodiment of the invention. FIG. 3 shows a plan view of the platform hull 41. In general terms, the subject offshore platform comprises a seabed template 43, which may or may not have supporting piles 44, and foundation anchor piles 45, a buoyant hull 41, which is anchored by tendons 46 connected to each of the anchor piles 45, and one or more decks 42 supported above the water surface 47. Well risers 48 from the seabed 49 are supported by riser supports 79 near the base of the hull 41, and well trees 50 are shown as submerged below the water surface 47.

Referring again to FIG. 1, the preferred platform 40 incorporates a deck 42 which has an elevation clear above the zone of wave action, and as shown, has an upper level 115, a mezzanine level 116 and a lower level 117. However, alternative deck arrangements may be used, such as one, two, or more decks. The deck 42 has a platform that can be rectangular or circular or other shape with perimeter trackways 66 on the upper deck 115 and 166 on the lower deck 117. A moveable well workover rig platform 67 is provided and supported on the deck trackways 66 and 166. The workover rig 67 is used to support well intervention equipment with the exception of the actual drilling of wells. The rig 67 can be moved around the deck trackway to any location and thus positioned directly above each of the well trees 50 which are positioned at locations corresponding to the travel path of the workover rig. A vertical riser 68 provides connection between the well trees 50 and the platform deck 42. Referring to FIG. 3, a mooring connection 71 for mooring a tanker 69 to the platform and connecting an offtake hose 70 from the platform to the tanker may also be provided. The mooring connection 71 is supported on a perimeter deck trackway 166 so that the mooring connection may be positioned on weather leeward side of the platform, no matter what the prevailing weather direction may be.

Figure 2:
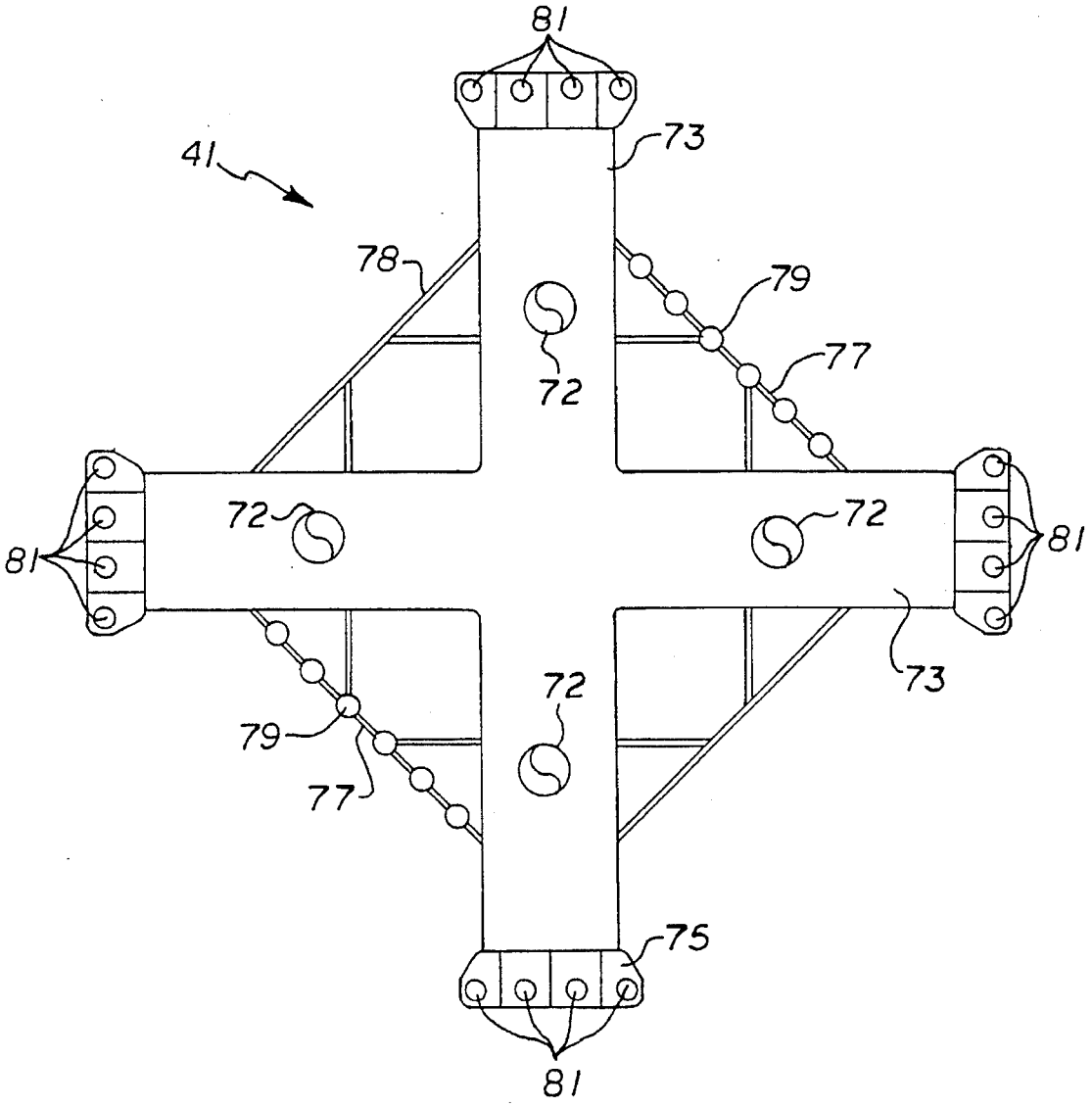
FIG. 2 is a plan view of the below water surface portion of the platform hull.

The hull body 41 (FIGS. 1 and 2) comprises a lower pontoon structure 73 and a plurality of columns 72 supporting the deck structure 42. FIG. 2 shows four columns 72, however any number may be used.

The pontoon structure 73 is positioned sufficiently deep below the water surface 47 so that hydrodynamic forces are reduced. The dimensions of the pontoon structure are sufficient to reduce the hydrodynamic forces and tendon tensions. The pontoon structure 73 may be rectangular or circular in cross section, or other cross sectional shapes, as desired. FIG. 2 shows two horizontally oriented pontoon structures 73 intersecting at approximately mid span, and oriented 90 degrees to one another= however any number of pontoon structures may be used. For instance, a single pontoon structure may be used, or three pontoon structures intersecting each other at one end may be used.

Bracing elements 77 and 78 provide added structural support between the pontoon structures 73. The hydrodynamic forces and the tendon forces can produce high stresses at the intersection of the pontoon structures 73 and the function of the bracing 77 and 78 are to reduce these stresses to acceptable levels.

The buoyancy of the hull 41 is provided primarily by the pontoon structures 73, and the below water portion of the columns 72. The remaining below water portion of the hull 41 is for structural purposes and does not provide a dominant contribution of buoyancy.

The pontoon structure 73 is compartmentalized by a series of bulkheads, similar to conventional surface floating tanker or barge hull subdivision means and therefore not shown. The purpose of the subdivision bulkheads is for controlling the progressive flooding and adverse effects of a leak in the hull structure at any location. The subdivision bulkheads also provide compartmentation used for placing ballast water during platform installation and during platform operation. The ballast water is used during installation to change platform draft, prior to connection to the tendons 46, and, after connection of hull to tendons, ballast water is used to adjust tendon tension. During platform operation, ballast water is strategically placed in various compartments to counteract the shifting of weights or changing of the platform center of gravity position, and thereby maintain nominal tendon tensions to within acceptable levels.

It is desirable that the area of the hull 41 which passes through the waterplane is as small as possible. The small waterplane area reduces the current loadings on the hull, and reduces the wave forces on the hull produced from short period waves, which are important fatigue considerations. Notwithstanding the foregoing desire to minimize the waterplane area, it is also an objective of the invention that the hull structure may be installed without the requirement for a cranevessel or temporary auxiliary buoyancy means. The upper portion of the hull 41 is therefore dimensioned so that the waterplane area is adequate to ensure the hull remains stable when the lower portion of the hull is completely submerged. In summary, the hull 41 is configured so that the body is buoyant and stable during towed transportation from shore to the site and also during the installation of the hull and its connection to the tendons 46, and so that the hull has minimal motion responses to hydrodynamic loadings.

Figure 4:
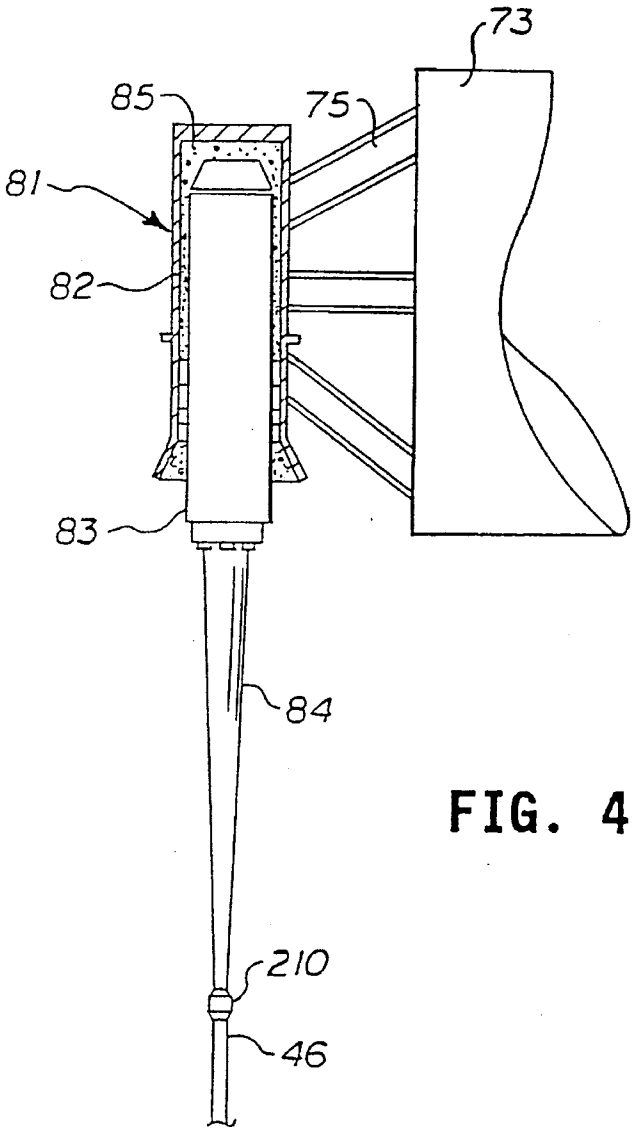
FIG. 4 is a sectional side view of the tendon connection for connection of a tendon to the hull.

In addition to the upper columns 72 and lower pontoon portions 73 of the hull 41, and structural bracing 77 and 78 which contribute in part to the structural connection of the pontoon structure 73, structural members 75 attached to the ends of the pontoon structure 73 provide the means of connecting the hull 41 to the tendons 46. As shown in FIG.4, the connecting structure 75 consists of plate and/or tubular elements and connection sleeves 81 which provide attachment means to the tendons 46. The position of the tendon connection sleeves 81 with respect to the center position of the hull is controlled by the magnitude of the tendon tension. Placing these connection sleeves 81 further away from the center position will reduce the magnitude of the tendon tension because it provides a larger level arm to resist the pitch and roll induced moments. The large distance of the connection sleeves 81 will have the adverse requirement to increase the span of the connecting structure 75 and/or to increase the length of the pontoon structure 73.

Figure 5:
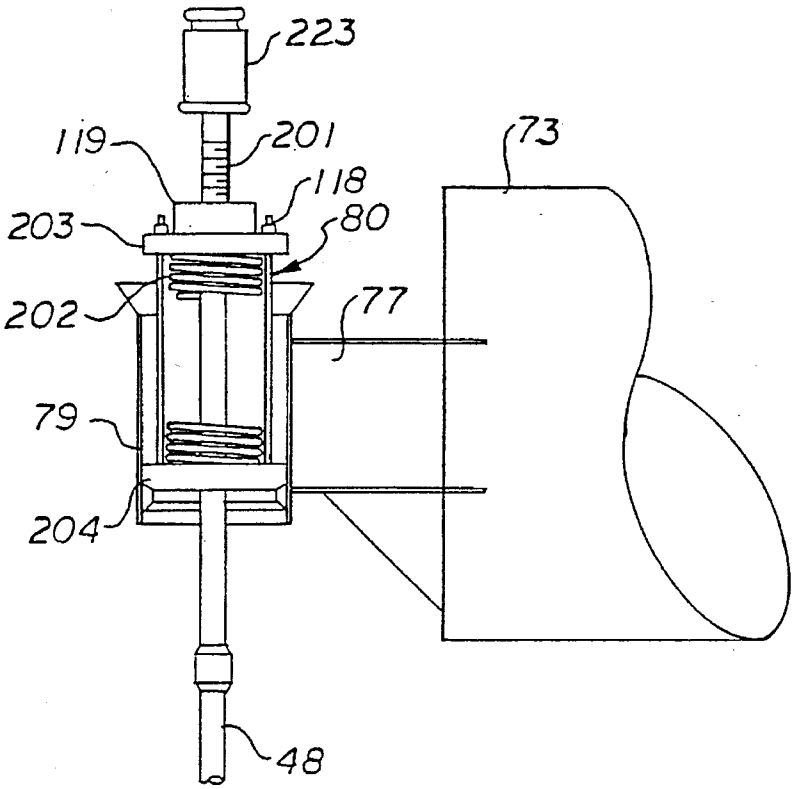
FIG. 5 is a sectional view of a well riser support for supporting the weight of the riser and tree and maintaining the tension of the riser generally constant.

As shown in FIG. 5, also attached to the pontoons 73 are riser support structures 79 secured by bracing elements 77 which support the production well risers 48. The riser supports 79 are positioned at this elevation so that the payload of the wells 50 and risers 48 are not supported at deck level thereby avoiding additional deck size and weight, it being a basic objective of the invention to minimize the above water weight and size of the platform. The elevation of the supports 79 is also desirable to be close to the elevation of the top connections of the tendons 46. The tendons 46 and risers 48 being of similar length minimizes, as previously mentioned, the effective length variation of the risers when the platform is set down when subjected to horizontal forces. The riser supports 79 incorporate a riser tensioner 80 for adjusting the riser tension to the desired magnitude and thereafter maintaining the tension within prescribed limits notwithstanding effective variations of the length of the risers. The riser supports 79, after installation of the risers, requires no maintenance nor adjustment during the operation of the platform; this being desirable given that the riser supports are submerged below the surface of the water 47.

The riser tensioner means 80 comprises a threaded length adjustment riser joint 201 that is attached to the upper portion of the tubular riser 48, a nut 119 that attaches to the adjustment joint 201, which is in turn supported by an upper flange 203 which reacts against one or more spring elements 202. The spring elements 202 can either be concentric with the axis of the riser, or alternately can be a series of springs that are eccentric to the axis of the riser, or a combination of eccentric and concentric springs. The spring elements 202 can be steel or other metal and of a helical compression design, or can be other known spring designs such as Bellville washers as are used in supporting large loads with short strokes. The spring element can also be non-metallic such as an elastomeric compound as used for similar load bearing applications. The spring element 202 is reacted at its base by a lower flange 204 which is supported on the sleeve 79.

The top of the riser 48 contains the tubing head mandrel 223 which provides the vertical support for the internal production tubing. Now referring to FIG. 6, the tree 50 attaches to the mandrel 223 (not shown) by means of the mechanical connector 401. Flexible jumpers 408 for produced well fluid conduits, control lines, chemical lines, and others attach to the tree 50 and connect to rigid piping and conduits 409 that are attached to the hull 73. A diver work platform 410 can be used to assist the various diver operations involved in connection and disconnection of said tree and equipment, and also for routine maintenance thereof.

Figure 6:
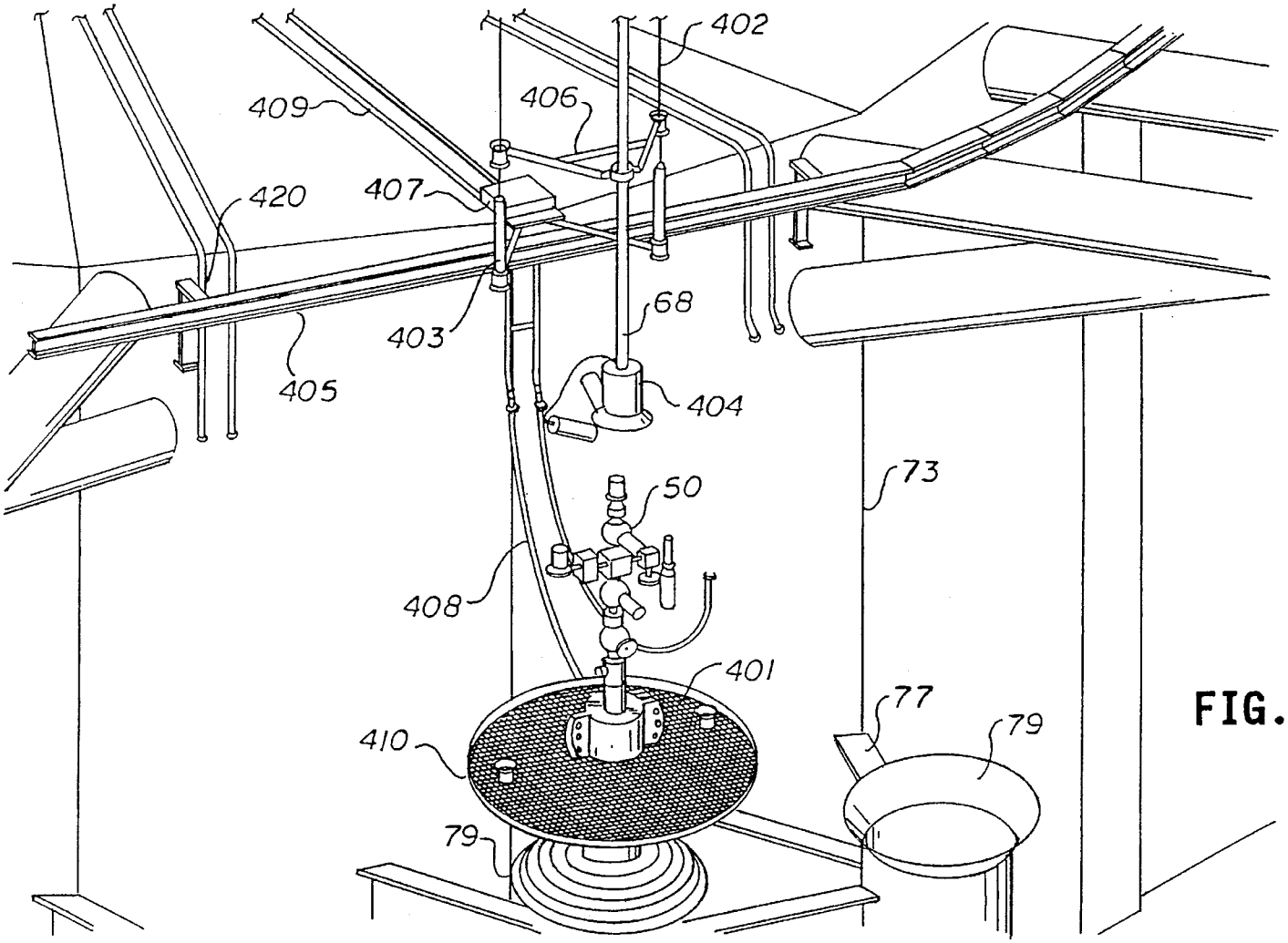
FIG. 6 is a three dimensional view of the riser tensioner device and the tree above, and shows a means by which equipment for inspection, maintenance and well access can be lowered by guidelines that are remotely positioned on a track.

The production trees 58 may be located directly above the riser tensioner receptacles 79, as shown in FIG. 1 and FIG. 6. Alternately, the production trees can be located above water, as shown as element 220 in FIG. 7. Now referring to FIG. 7, the risers 48 are supported and tensioned by the riser tensioner element 80 which is supported inside receptacle 79 as previously described. The production tubing, located inside the riser 48, provides a conduit for the produced well fluids and the production tubing is supported at the well tubing head 223. Attached to the well tubing head 223 is an extension riser 222, which connects at the bottom to the tubing head 223 and connects at the top to the surface tree 220. To prevent the extension riser 222 from buckling, it is supported at the deck 221 with a nominal tension.

Referring again to FIG. 4, the tendon connections 81 permanently connect the hull to the tendons 46. A vertical tubular steel sleeve receptacle 82 attached to the pontoon 73 by means of structural elements 75 is provided for each tendon. A connection pipe 83 is attached by a stress joint 84 to the top of the tendon main body 46. The connection pipe 83 is inserted into the sleeve 82. Cement grout 85 is pumped into the annulus volume between the outer sleeve 82 and inner pipe 83. The hardened and cured grout 85 bonds to the inner and outer pipes whereby applied loads in the tendon 46 are transmitted to the inner pipe 83 through the grout 85 to the outer sleeve 82 and thereafter to the hull through pontoon 73. The grouted connection 81 does not require the precise relative positioning of the inner pipe 83 and outer sleeve 82 and hence provides a means of accommodating tendon length variations and thus avoids all need for other means of adjustment of the tendon lengths.

The tendon stress joint 84 is made of steel or titanium or other suitable material and connects to the pipe element 83 on top by a flanged or other suitable connection means, and connects to the tendon pipe 46 by means of the tendon tubular connector 210 which can be threaded, flanged, or other suitable design. The body of the tendon stress joint 84 can be a tubular of varying wall thickness, or a solid design with a varying outer diameter. The stress joint 84 allows relative rotation between the axis of the tendon pipe 46 and the sleeve 82 due to offsets and movements of the platform. Alternately, the tendon stress joint 84 may be replaced by a more conventional elastomeric bearing design, as used on conventional TLP tendons, or by a cardan or universal joint design.

Figure 8:
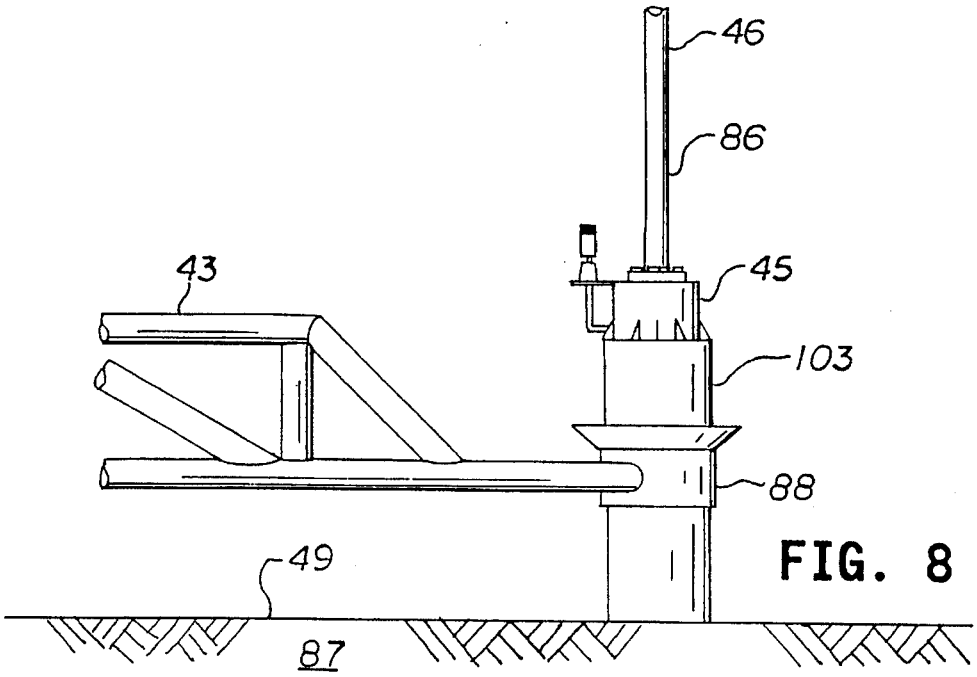
FIG. 8 is an elevational view of an installed foundation anchor pile and shows how the pile is positioned by the seabed template structure and how a tendon is connected to the foundation pile.

The elongated tubular tendons 46 connect the hull 41 to the foundations so that the hull is vertically anchored to the seabed 49. The number of tendons provided is variable and must be sufficient to provide the desired total anchoring pretension force on the hull. It is an object of the platform concept that the tendons may be manufactured using conventional steel tubular pipe segments as used for well drilling operations and practices. The materials used for the manufacture of the tendons influences the quantity of tendons necessary to provide the desired anchorage of the platform. As best seen in FIG. 8, the lower extremity of the tendon 46 comprises a steel or other metal stress joint 86 similar to the upper stress joint. The stress joint 86 dimensions and material of manufacture permit the tendon to articulate with respect to the fixed anchor pile 45. Each platform tendon 46 is anchored independently to the seafloor by a steel tubular pipe pile 45 which is penetrated into the subsoil 87, which in turn anchors the pile.

Instead of a direct connection of the bottom of the tendon 46 to the pile itself by, for instance, a flanged mechanical connection, the tendon base can have a pipe section that fits inside the pile 45, and then the annulus between the pile and the pipe is grouted.

Figure 9:
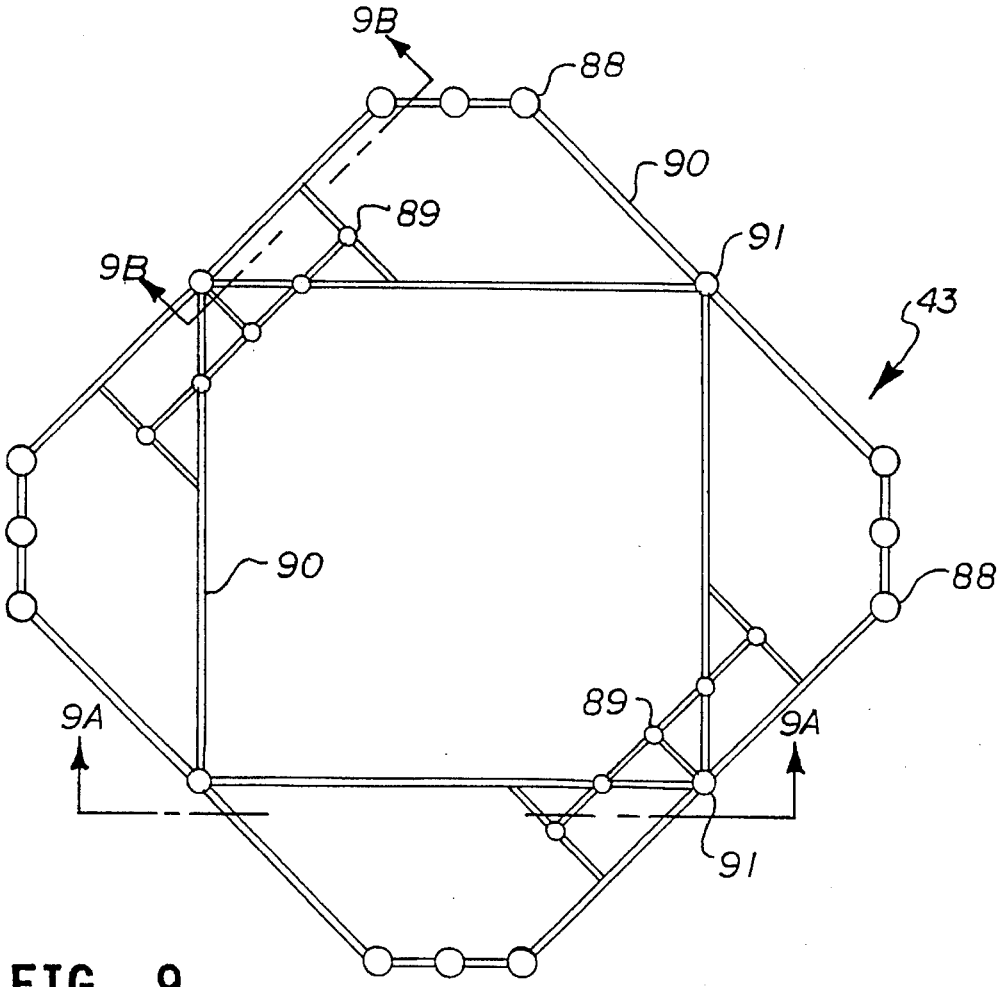
FIG. 9 is a plan view of the seabed template structure which positions the foundation anchor piles and production wells.
Figure 9A:
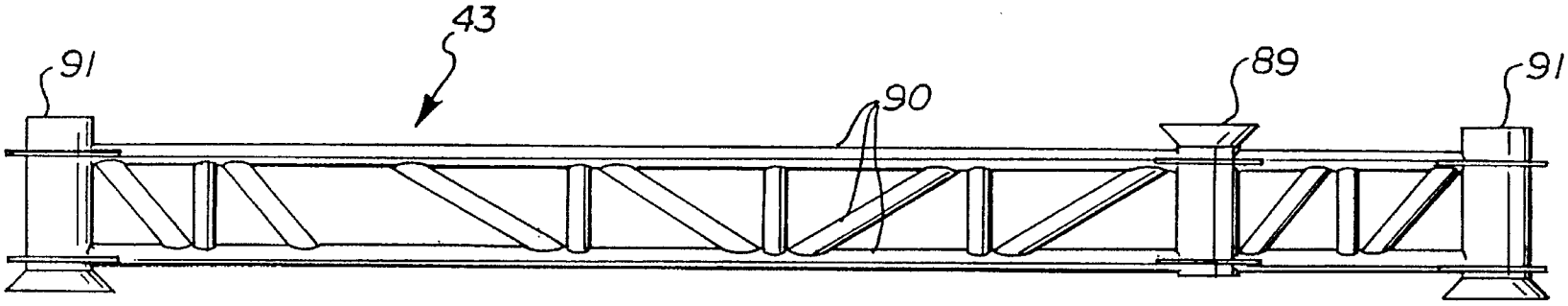
FIGS. 9A and 9B are sectional views of the seabed template structure taken along lines 9A—9A and 9B—9B of FIG. 9.
Figure 9B:
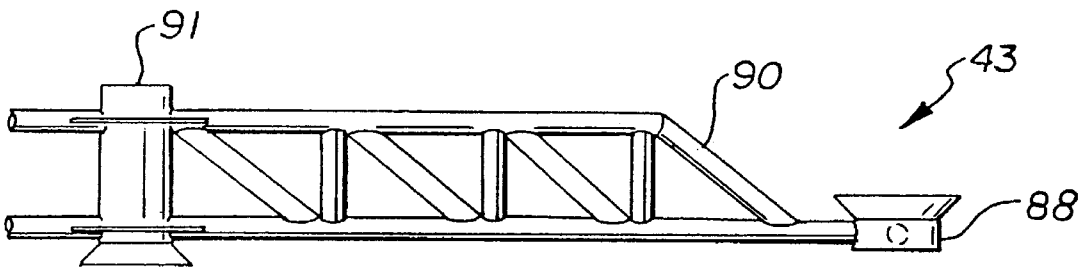
Figure 10:
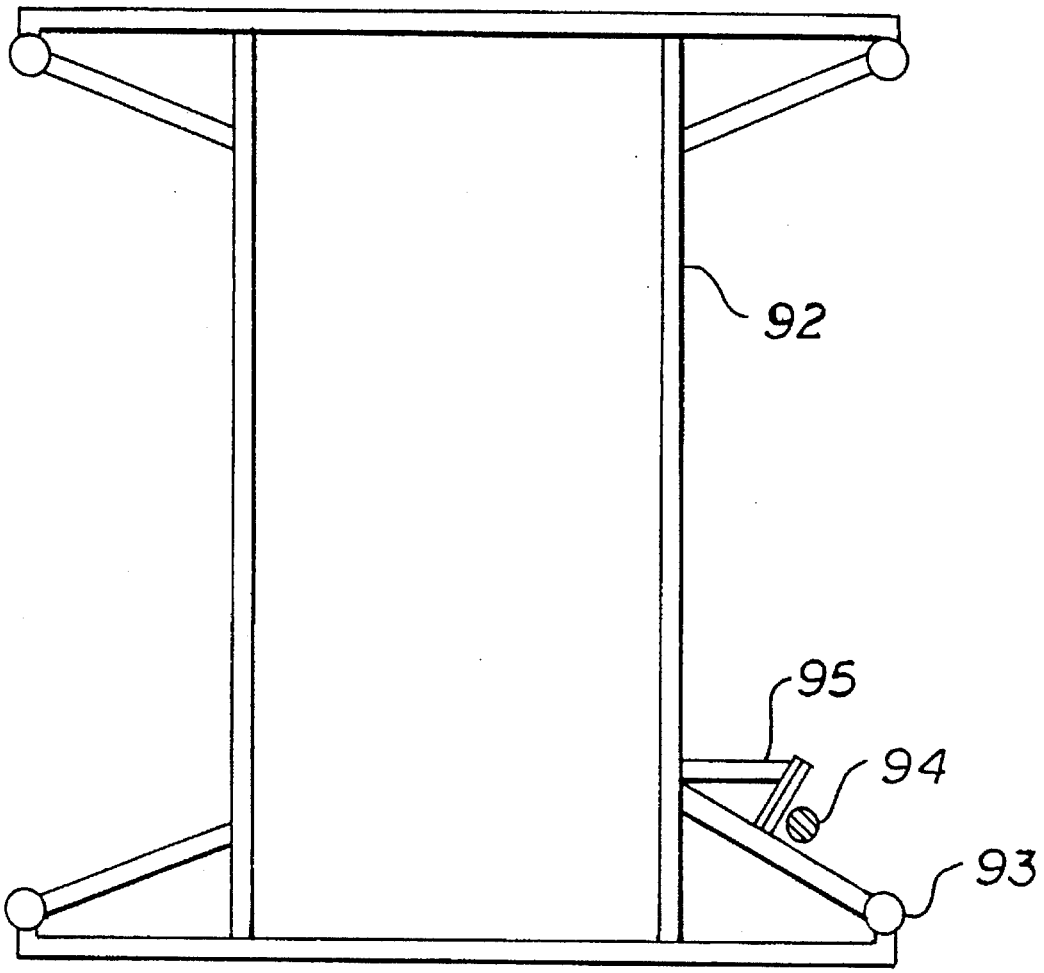
FIG. 10 is a plan view of a seabed frame which positions support piles for the template structure when it is desirable to support the template by piles in a desired location with respect to an existing seabed well.

A seabed template structure 43 (FIGS. 9, 9A and 9B) manufactured with steel tubulars 90 and plate is provided as previously mentioned. The template structure 43 incorporates guide receptacles 88 which position the anchor piles and guide receptacles 89 which position the wells 50. As previously mentioned, depending on the load supporting capacity of the seabed soil, the template structure 43 may either be supported directly by the seabed surface 49 or by support piles 44 which penetrate into the subsoil 87. In the case of the latter support means, the template structure 43 incorporates pipe support receptacles 91 which correspond to the support piles. The support piles 44 are positioned by a simple steel seabed frame structure 92 (FIG. 10) which is placed on the seabed. The seabed frame 92 incorporates guide receptacles 93 for the support piles 44.

Figure 7:
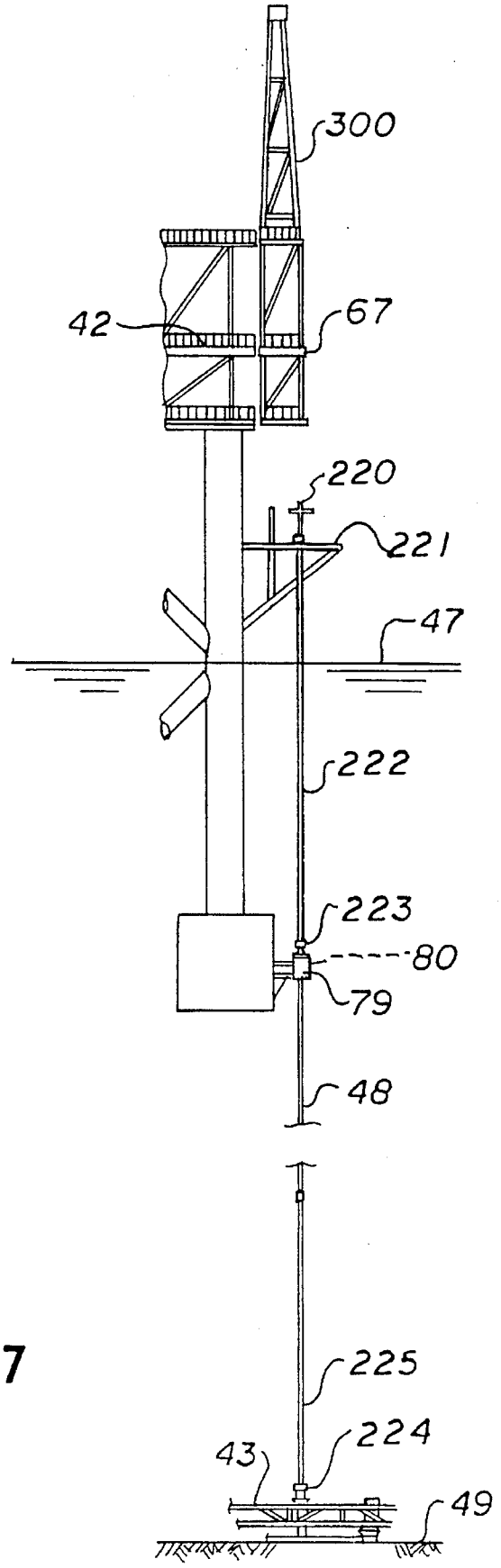
FIG. 7 shows an alternative riser arrangement with the riser supported by the hull at the elevation, and with the tree positioned some distance above the water surface and connected by a pressure tight riser to the riser supported by the hull.
Figure 11:
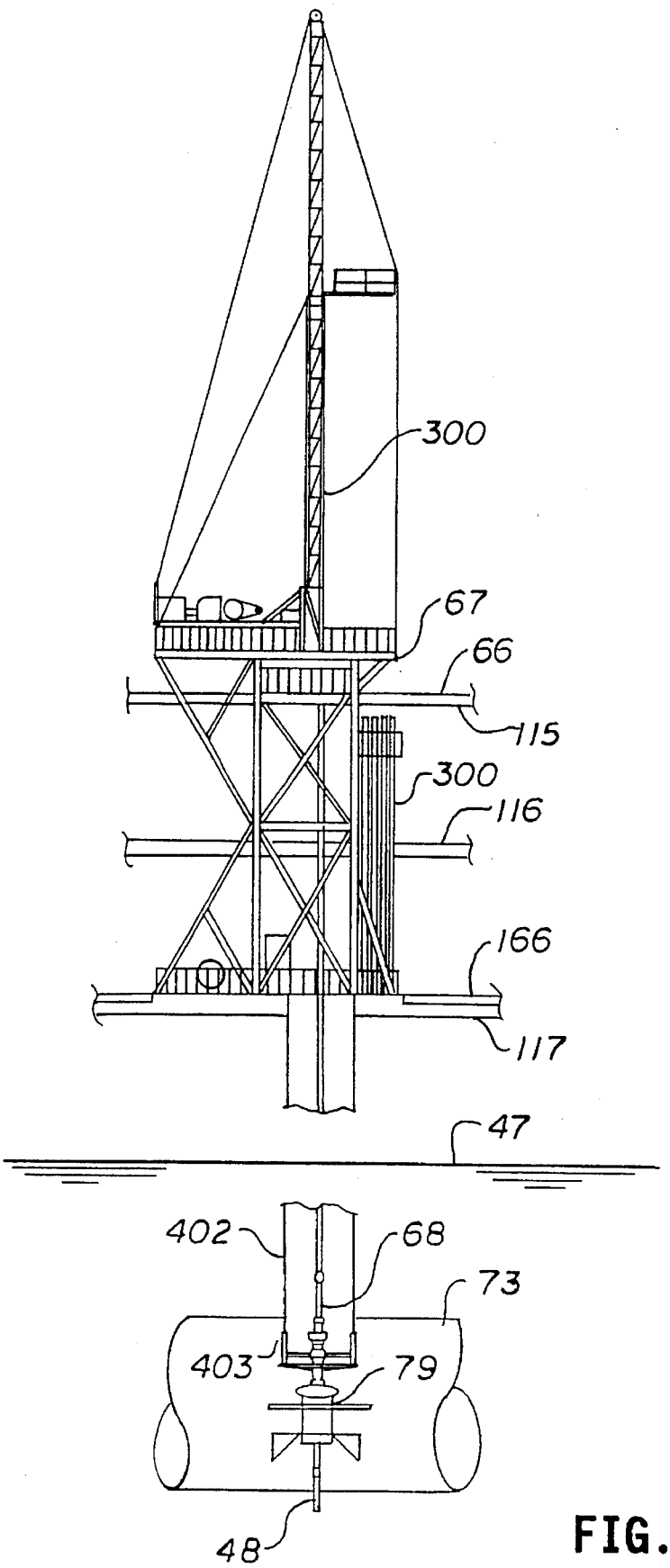
FIG. 11 is an elevational view of the completed installed platform and illustrates the skiddable workover platform supporting workover equipment when connected to a desired well riser and tree and the workover platform being engaged in operations on the well during the production operations of the working platform.

The following paragraph describes the well workover system, which is shown in FIGS. 1, 7, and 11. The skiddable workover support structure 67 is supported by tracks 166 on the lower deck 117 and tracks 66 on the upper deck 115. The support structure 67 is skidded from one location on the periphery of the deck to another location on the deck periphery by jacking or winching, or other suitable means. The workover support structure 67 supports workover equipment 300 which is used to perform well workover operations such as completion of the well with tubing strings, removal and reinstallation of tubing, flushing, cleaning, scraping the well bore, operating sliding sleeves, and all other types of well workover operations. The well workover equipment is also used to install and retrieve the riser 48. During workover operations that require the removal or installation of tubulars, the tubulars 301 are substantially free of dynamic loading from platform movements, and allow the collapsing and securing of the well workover equipment 300 prior to an extreme storm condition. The workover equipment 300 is shown in the collapsed condition in FIG. 1. During well intervention operations, a temporary riser 68 is used to provide a conduit from the top of the production risers 48 or from the trees 50 or 220. FIG. 6 shows the lowering of the riser 68 onto the tree 50. Guidance means can be used, such as guidewires 402 attached to guideposts 403 which guide the riser 68 by means of a guideframe 406. The guidewires 402 and guideposts 403 may be indexed adjacent to a desired receptacle 79 by means of sliding a trolley device 407 on a track 405 that is attached to the hull 73 by brackets 420. The trolley device 407 can be operated remotely, thereby not requiring the use of divers or remotely operated vehicles (ROV) to perform routine operations.

Figure 12:
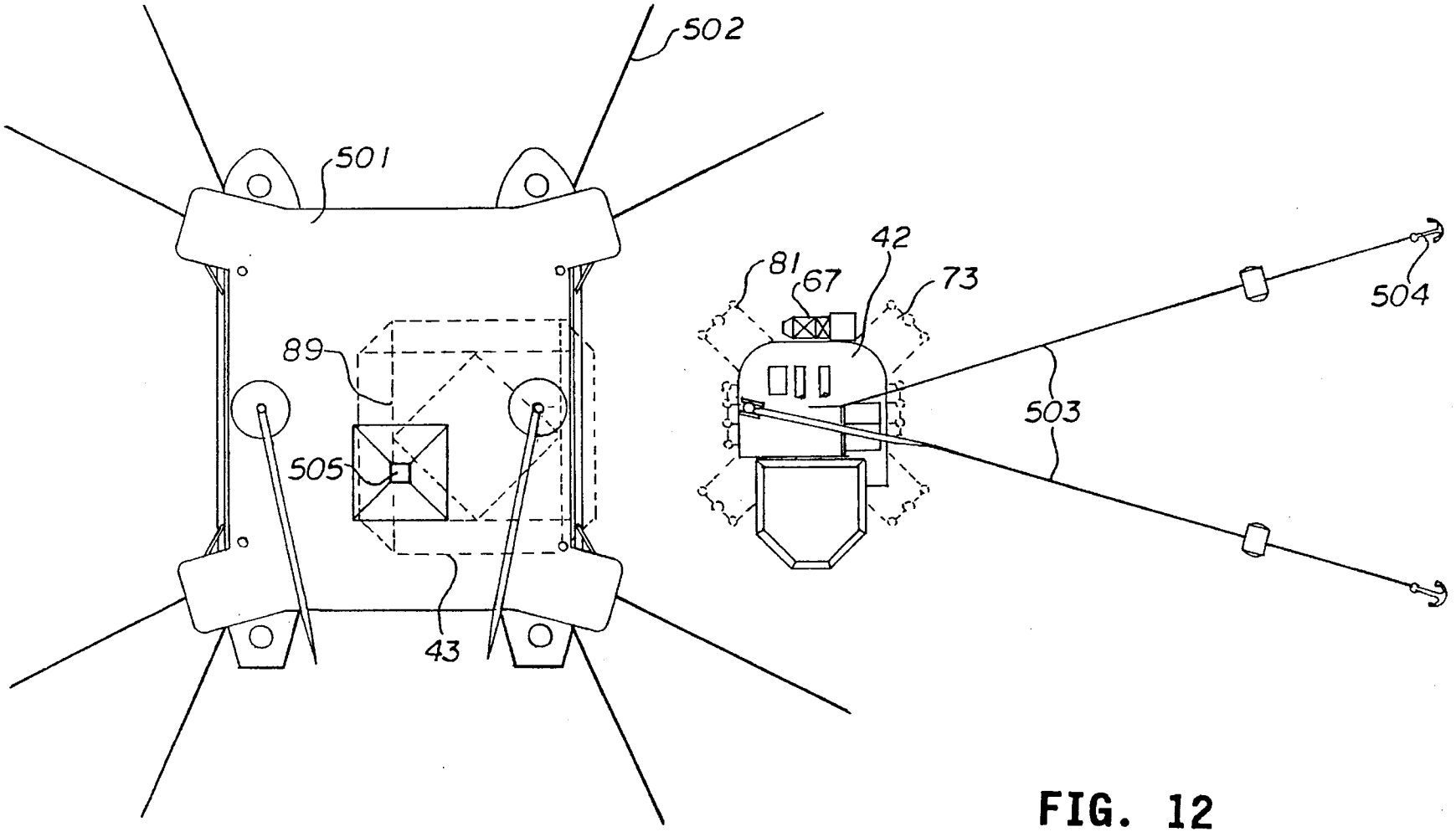
FIG. 12 is a plan view ilustrating a method of performing post-installation drilling by temporarily offsetting the platform with one or more temporary anchor, and temporarily positioning a mobile offshore drilling unit over the intended well, to perform well drilling.

Well drilling operations are performed by a floating mobile offshore drilling rig, prior to installation of the platform. After installation of the platform, wells can be drilled by placing drilling equipment on the deck. However, it may not be desirable to do so unless a large number of wells are so drilled from consideration of overall weight, deck loading and the provision of sufficient deck area. In the case that well drilling is not performed on the platform, a floating mobile offshore drilling unit (MODU) can be used, as illustrated in FIG. 12. A single or plurality of temporary conventional mooring means 503 consisting of for instance, anchor, chain, wire, buoys, and connection equipment is deployed and connected to the side of the platform that is opposite to the well slot to be drilled. The platform 40 is offset away from the template 43 by tensioning the mooring lines 503 a sufficient amount so that there is adequate space to position a MODU 501 over the template well in question 505 that is located on template 43. The MODU 501 may be connected to its own mooring 502, or it may be positioned by dynamic position system. The well is drilled by using the MODU's drilling equipment and drilling riser system. After the well has been drilled, an additional well can be drilled by repositioning the MODU on its station keeping system. After completion of drilling, the MODU is removed, and the platform 40 is returned to it's normal position, and the temporary mooring means is 503 removed.

METHOD OF INSTALLATION

The method of installation is now described. Specialized installation vessels and equipment, such as underwater pile hammers, are not required for installation. This is particularly significant for platform sites where such vessels are not normally based. The whole platform may be installed at site using a conventional deepwater drilling vessel, equipment and practices. Other methods and means may also be used. A semisubmersible drilling vessel (SSDV) may also be used to drill the platform production wells; therefore, if the vessel is used to perform all the work, well drilling and platform installation works may be integrated and, for example, the foundation piles may be installed before, during or after the operations of drilling the production wells. For the purposes of this description, it is assumed that the wells are drilled prior to installation of the foundation anchor piles. It is further assumed that the seabed template structure 43 is supported by piles 44. The components of the platform are sequentially installed at the site as described briefly here below, and listed in Steps 1 through 6. The sequence of operations is as follows:

(1) Installation of Pin Piles and Pin Pile Frame

Figure 13:
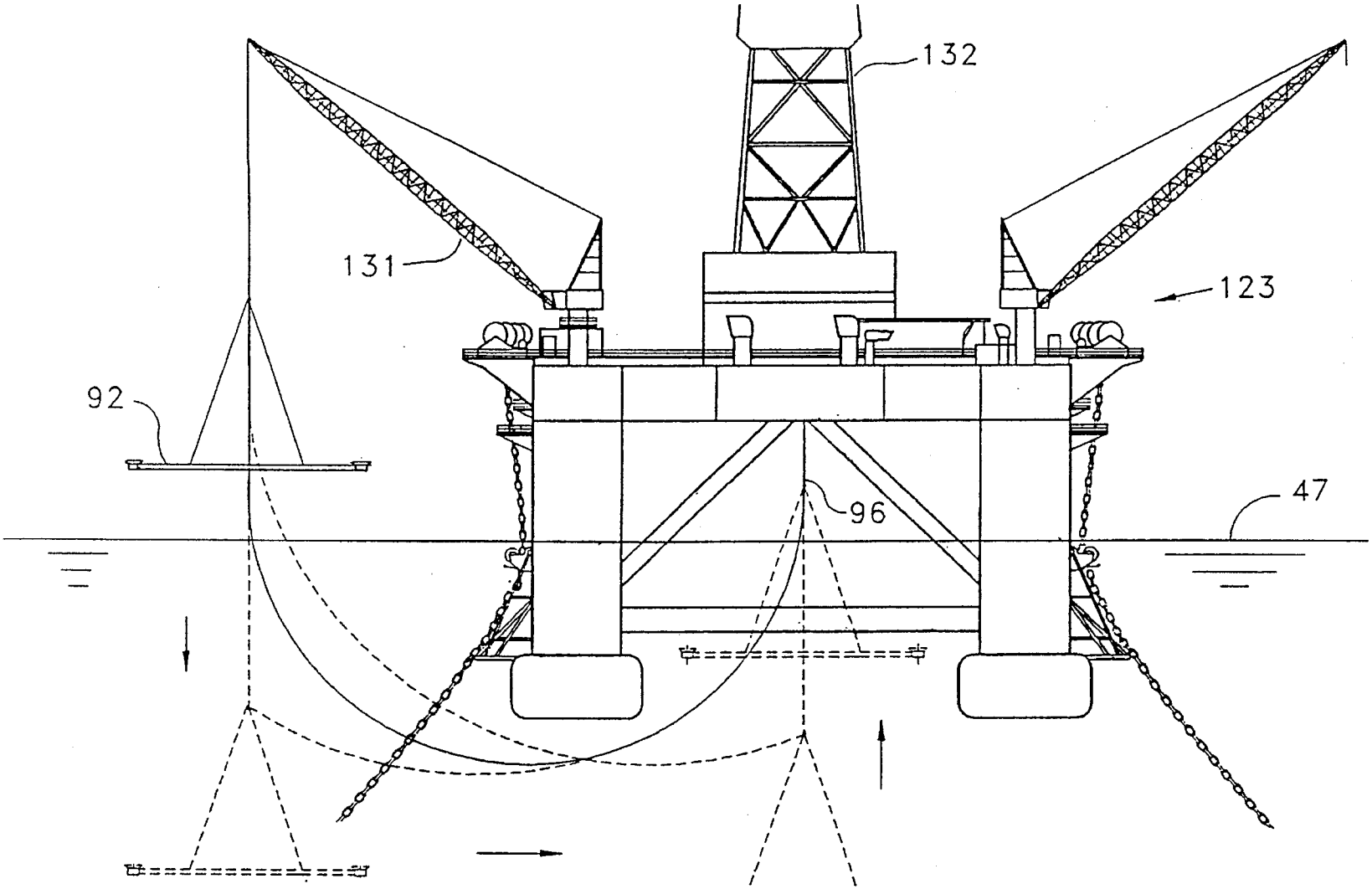
FIG. 13 shows a method of lifting the seabed frame from a transport vessel and of suspending the frame from the rig hoist of a drilling vessel.
Figures 14A, 14B:
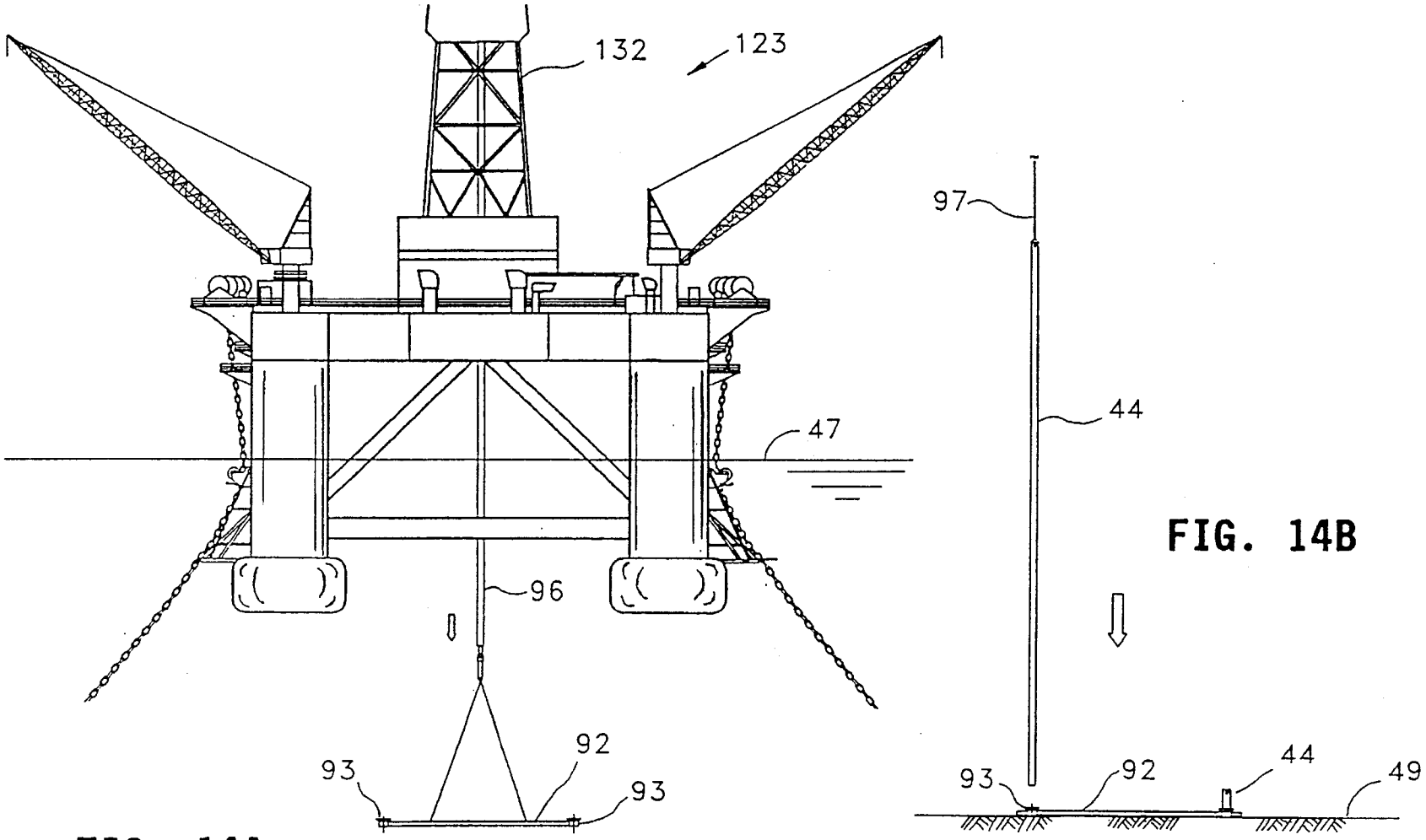
FIGS. 14A and 14B show a method by which the seabed frame is lowered by a drilling vessel from near the water surface and emplaced upon the seabed and thereafter how piles for the support of the seabed template structure may be lowered and positioned by the frame and how the piles are penetrated into the subsoil using conventional jetting procedures.

The pin piles 44, anchor piles 45 and tendons 46 are fabricated in sections. These are boat-transported to the SSDV installation vessel at site, assembled and deployed vertically by the rig using standard drilling practices and equipment. This small, light pin pile seabed frame structure 92 (FIG. 10) is loaded out onto a supply boat for transportation to the site where the drilling vessel 123 is moored up over the platform location. The seabed frame 92 is lifted off, by a platform crane 131, keel hauled and suspended from the drilling riser 96 below the rig 132 (FIG. 13). Assembling and running the riser string 96 (FIG. 14A), the frame 92 is lowered and landed on the seabed 49. If an exploratory well 94 (FIG. 10) is to be used for production, guides 95 are provided to index the frame with respect to the existing wellhead. Using normal drilling procedures, pin piles 44 are assembled, lowered on the drillstring 97 and jetted to the required penetration (FIG. 14B). The pile elevations are then surveyed and height adjustment add-on cans 121 (FIG. 14) are fabricated so that when installed later the pile tops are in the same horizontal plane.

(2) Installation of Template

Figure 15A:
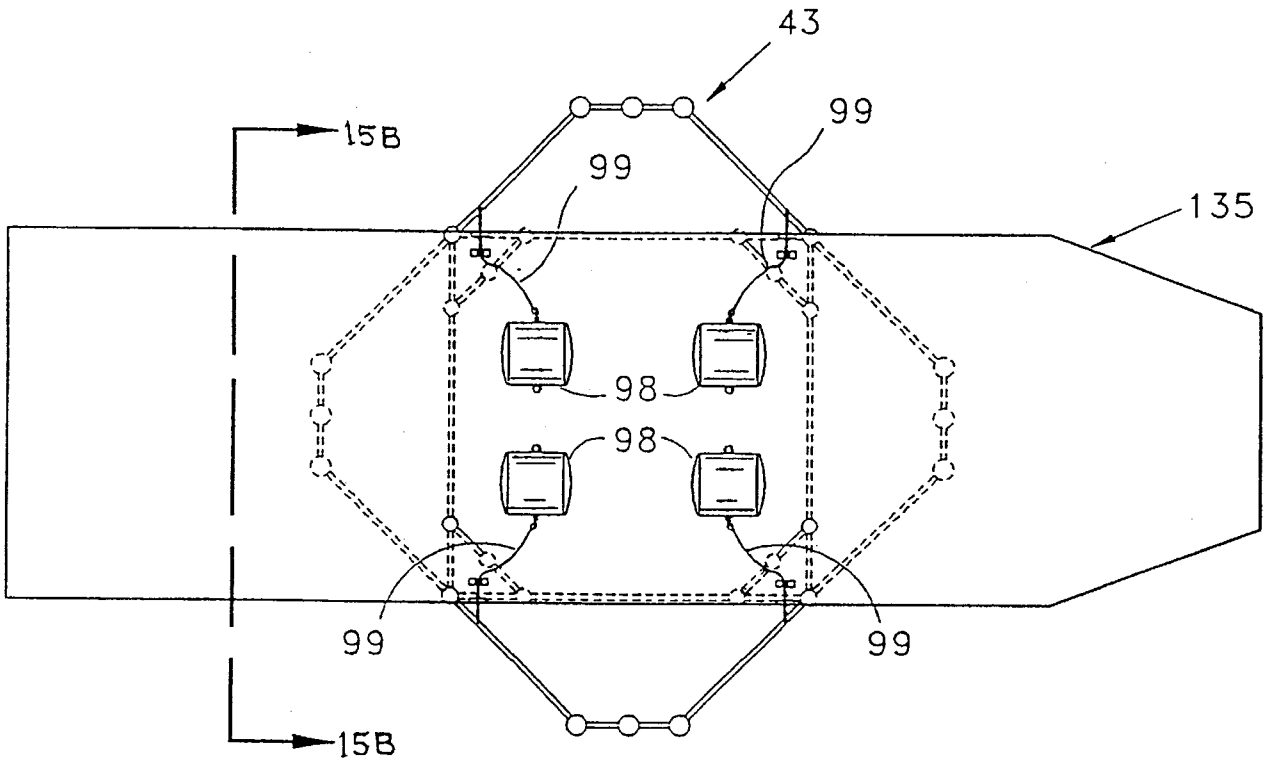
FIGS. 15A and 15B show a method by which the template structure is transported, suspended beneath a conventional cargo barge.
Figure 15B:
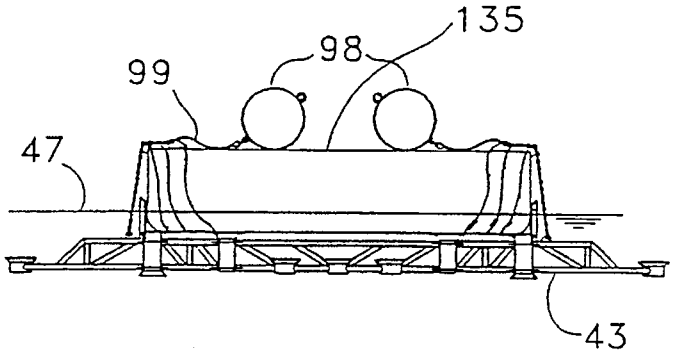
Figure 16A:
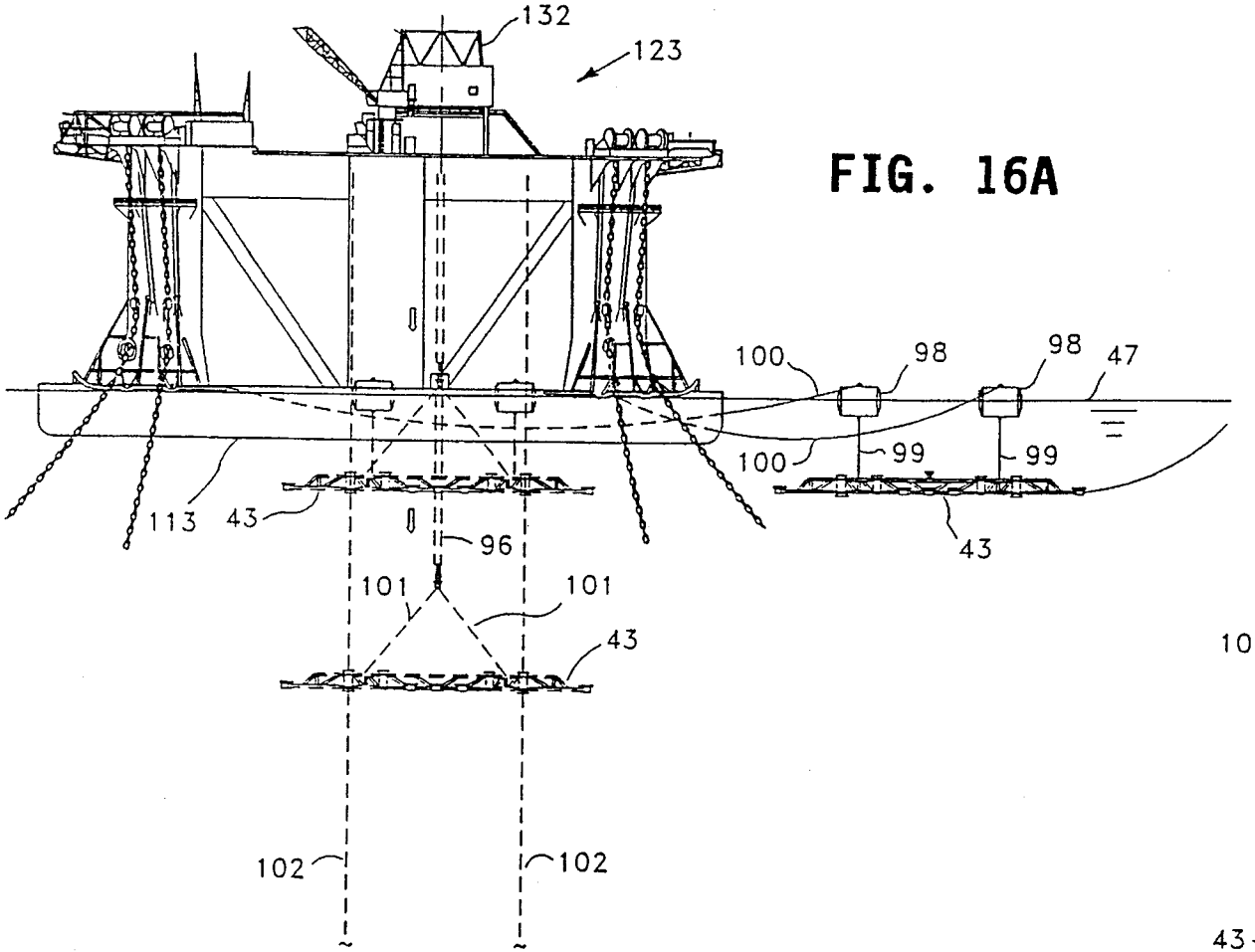
FIGS. 16A and 16B are elevational views illustrating a method of how the template structure, after release from the cargo barge, is towed submerged and suspended from conventional flotation devices to the platform site and how the template structure is positioned below the rig of a drilling vessel and connected to and suspended from the rig hoist, and then how the template may be lowered from the rig, by assembly of a riser pipe until the template structure is emplaced on the seabed surface or, in the case of using support piles, is placed over and onto the support piles.
Figure 16B:
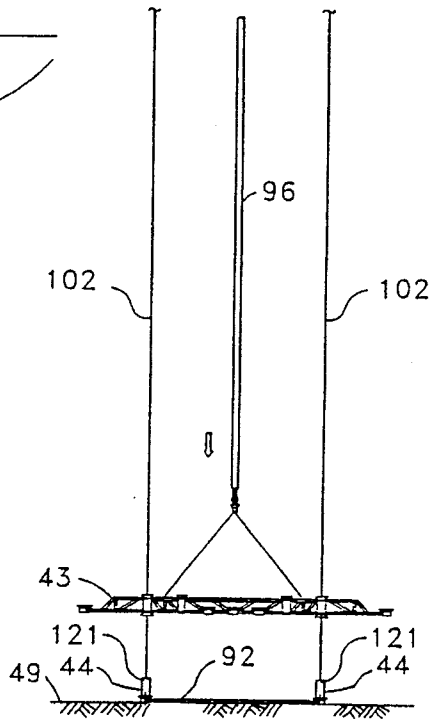

The template structure 43 is loaded out and secured under a typical small cargo barge 135 (FIGS. 15A and 15B). Suspension buoys 98 are secured on the barge deck with lines 99 pre-installed to the template 43. A waterdepth of 10 to 12 feet along the tow route is sufficient to avoid grounding of the template. The barge is towed to a location where the desired greater waterdepth is available. After launching the buoys 98 into the water, the template 43 is released from the barge. After maneuvering the barge clear, the template 43, suspended from the buoys 98, is towed to the site. The template release operation may also be performed at the site. Maneuvering lines 100 are connected from the SSDV 123 (FIG. 16A), which is deballasted up onto its hull pontoons 113. The template 43 is then floated under the vessel and the riser 96 connected to lowering slings 101, pre-installed on the template. Guidelines 102 are used to lower and engage the add-on cans 121 onto the pin piles 44 (FIG. 16B). After taking up the template payload on the riser 96, the buoys 98 are released and pulled clear. Assembling the riser string 96, the template 43 is lowered down the guidelines 102 and landed out over and onto the support pin piles 44. The template 43 is now ready for the production well drilling program to be commenced and for the installation of the foundation anchor piles.

(3) Installation of Foundation Piles and Tendons

Figure 17A:
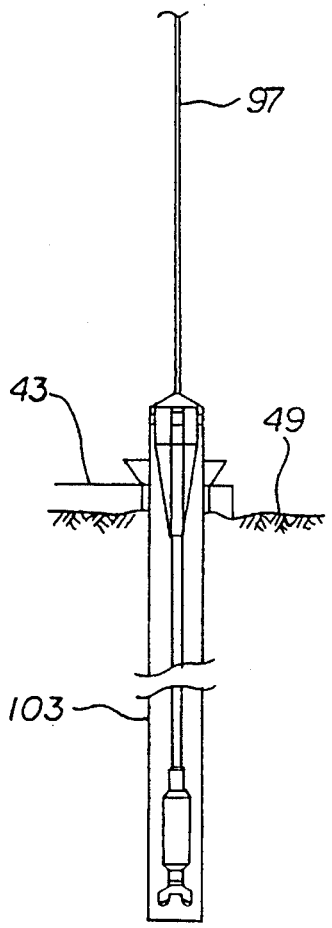
FIGS. 17A and 17B show elevational views of a method by which a drilling rig may lower from the surface to the seabed and then by jetting procedures install a foundation pile casing/liner and then how the rig may drill a hole down beyond the lower extremity of the casing.
Figure 17B:
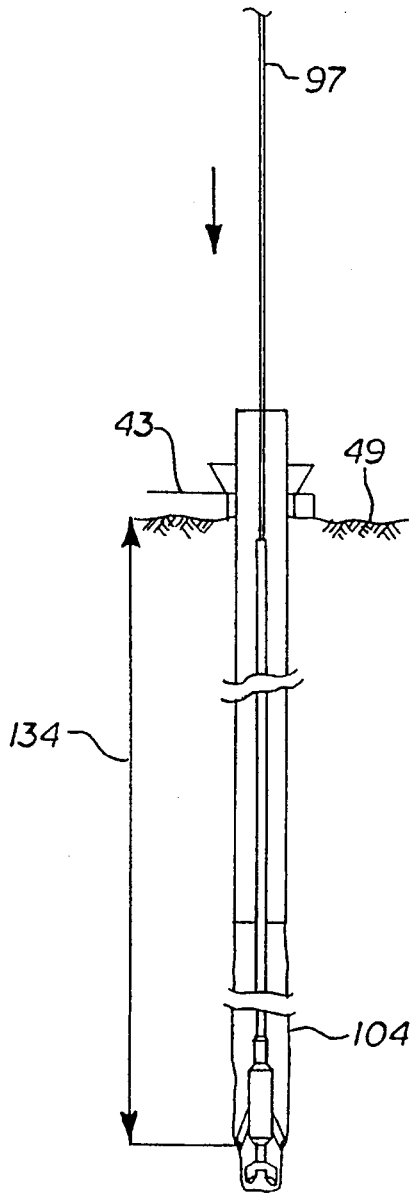
Figures 18A, 18B, 18C:
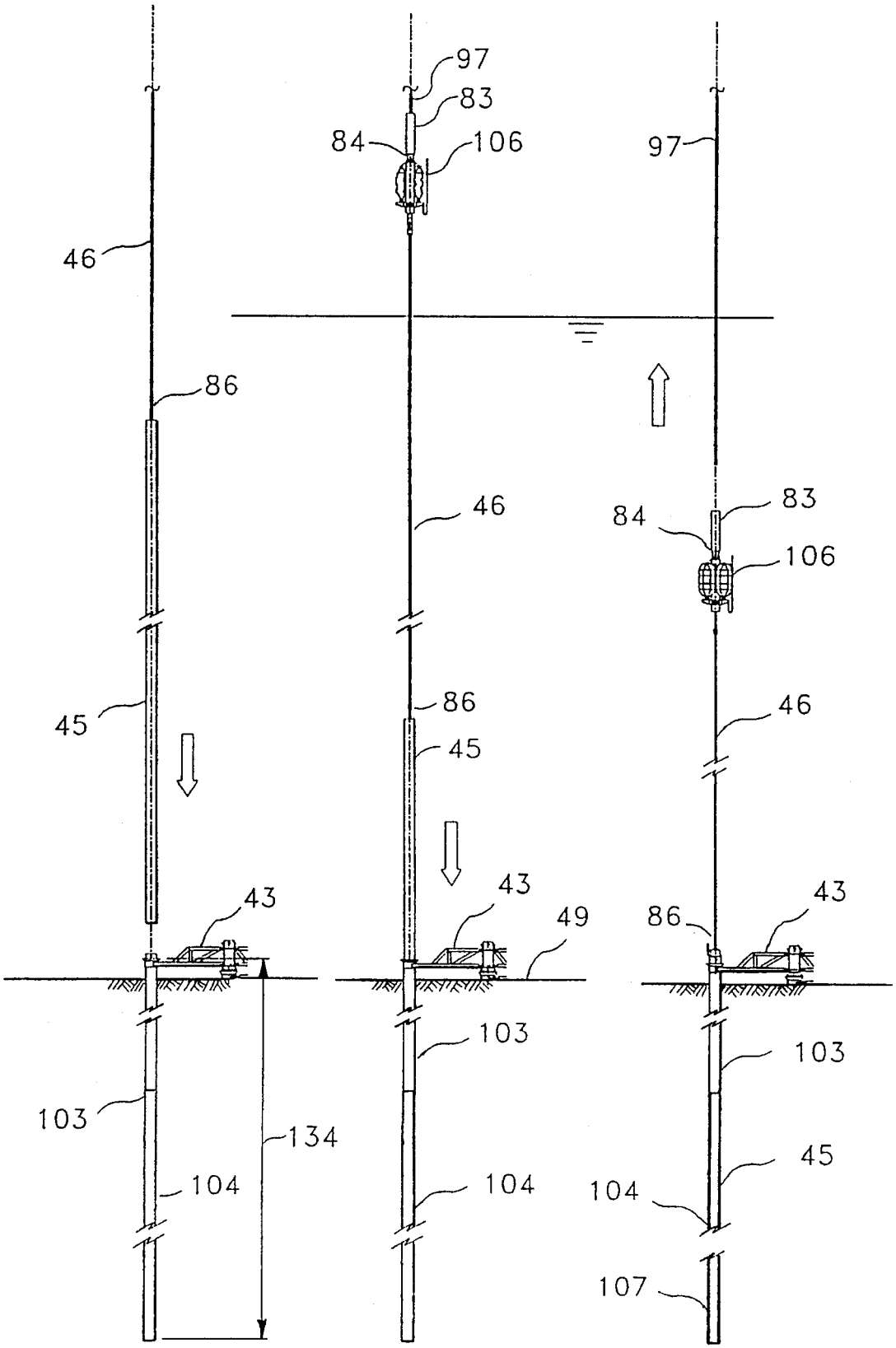
FIGS. 18A, 18B, and 18C are elevational views of the stages of the installation of a foundation pile/tendon assembly using a drilling vessel, and comprise assembly of the foundation pile sections to form a complete pile and connection of the tendon lower extremity to the top of the foundation pile and assembly of sections of tendon to form a length of tendon, thereby lowering the foundation pile towards the subsea template and lowering the pile through the desired template guide receptacle and into the foundation pile casing/liner and bored hole and completion of the tendon assembly, connection of top connector pipe, attachment of temporary buoyancy means and further lowering and then rotation of the rig drill string, from which the tendon is suspended, to engage and secure the foundation pile to the installed casing and inflation of the temporary buoyancy means thus supporting the tendon and permitting disconnection of the rig suspension drill string.

On completion of well drilling activities, or as previously mentioned when desired, the platform anchor piles and tendons are installed in two stages. The casings 103 for all the piles are first run on the drillstring 97, jetted in to the required penetration and the holes 104 for the piles drilled to the desired depth 134 (FIGS. 17A and 17B). Each pile 45 and tendon 46 is deployed as an assembly, run down guidelines and stabbed into the installed casing 103 (FIG. 18A). The pile has a temporary J-slot connection 105 (FIG. 18B) to the top of the casing pipe 103. After this is engaged, the tendon temporary buoyancy assembly 106 is inflated so that the tendon 43 is free-standing and the drillstring 97 can be released and recovered (FIG. 18C). When all tendons 43 have been installed, the foundation piles are grouted 107 by suitable means, similar to grouting well casing.

(4) Connection of Hull to Tendons

Figure 19:
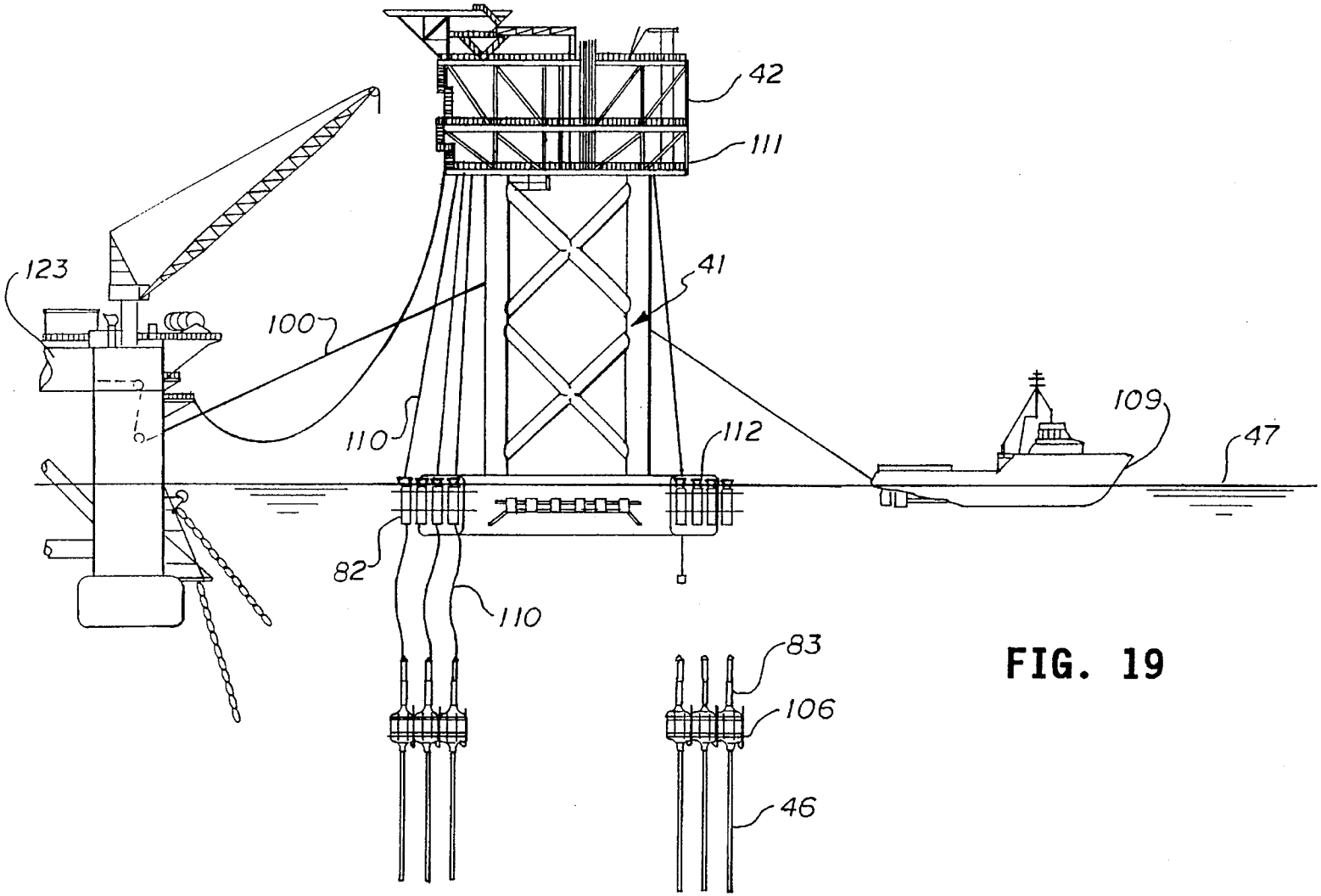
FIG. 19 shows an elevational view of a method by which a drilling vessel, with assistance of tugboats, may position the platform hull over and directly above the installed and anchored tendons.
Figures 20A, 20B:
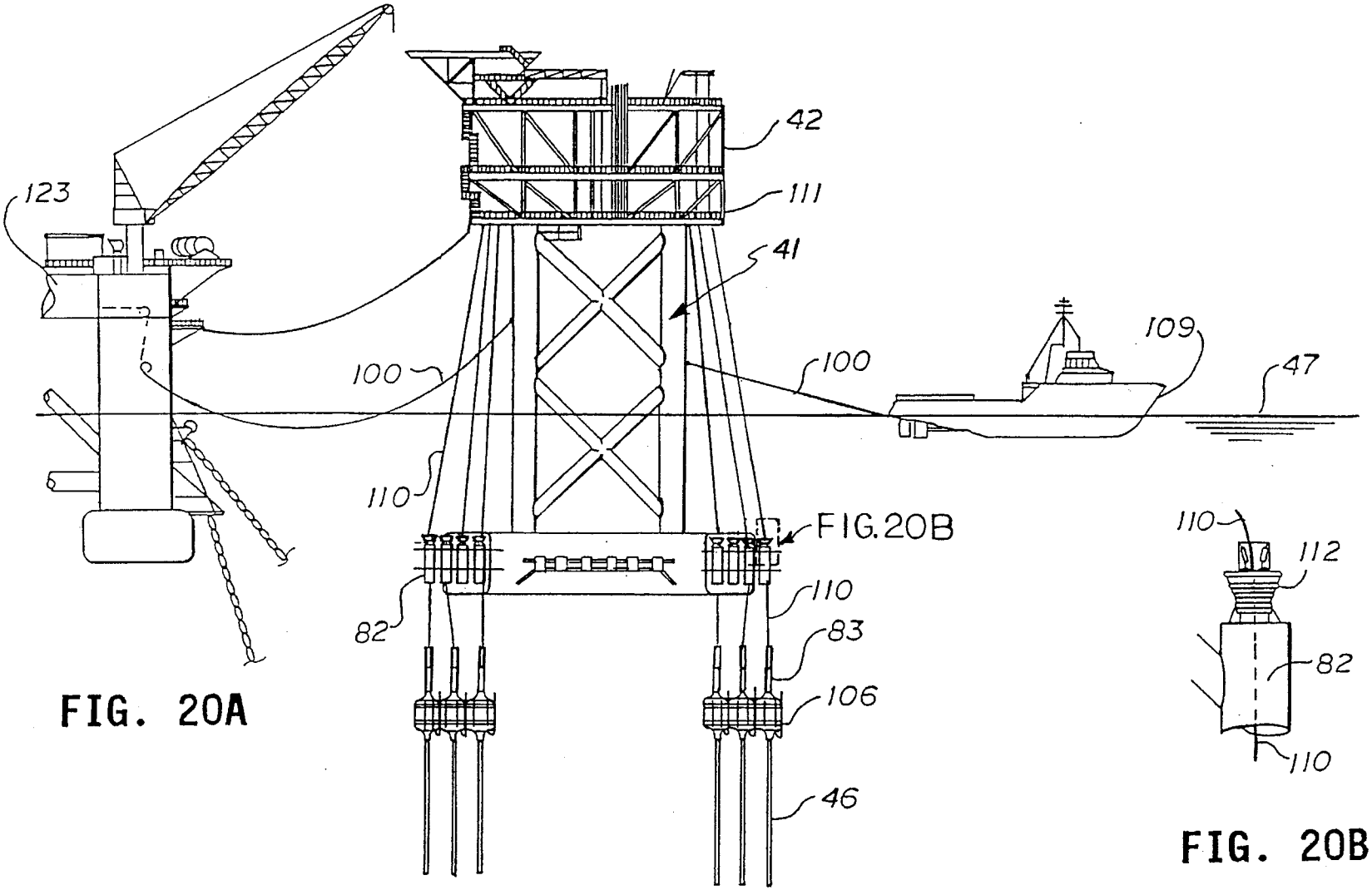
FIGS. 20A and 20B are elevational views which illustrate a method by which the platform hull is ballasted to increase its draft, and as the draft increases the installed tendons are aligned with and inserted into the connection sleeves of the hull and how the draft is increased until the hull is at a desired draft and then deballasted, and the hull being restrained from moving upward, and how the tendons are tensioned by the resulting deballasted hull desiring to move upward against the restraint of the anchored tendons.

Recognizing waterdepth limitations at many offshore structures fabrication yards the hull structure may be loaded onto a cargo barge for the inland/inshore towage route if there may be insufficient waterdepth to tow the floating hull structure. When the tow arrives at a location with sufficient waterdepth the barge is ballasted and trimmed until the hull can be floated off at minimum hull draft possible. After ballasting the hull to the desired draft the hull is towed to the site. SSDV 123 control lines 100 and assist tugs 109 are then used to maneuver and position the hull over the tendons (FIG. 19). Pre-rigged tension lines 110 are established from the tendons through the connection sleeves 82 and up to a temporary winch deck 111. Gripper units 112 are then activated and the hull ballasted down over the tendon top connectors (FIGS. 20A and 20B). The grippers 112 allow the hull to rachet down the tension lines, and prevent any upward movements during the transitional increase in the hull draft 128. When the hull reaches the prescribed draft and horizontal trim, ballast water is pumped out to pretension the tendons. Having locked off the hull, the permanent tendon top connections 81 are grouted 85 (see FIG. 4). Having completed the hull connections, and using the SSDV platform crane 131, the temporary buoyancy assemblies 106 are deflated and removed as well as the tension lines 110, gripper units 112 and winch platform 111, and the SSDV 123 is then demobilized from the site.

(5) Installation of Topsides

The topsides may be installed complete with the hull prior to towout, or it may be installed separately, and described as follows. A crane vessel is required to install the integrated deck structure complete with all production equipment and facilities. This topsides package is loaded out, transported on a barge and then lifted onto the hull using conventional procedures and the structural welded connection of the deck structure 42 and the platform hull 41 is performed. If available, a DP installation vessel is desirable; however, it is technically feasible to perform the topsides installation with a lift vessel moored to the hull structure and with assisting tugboats.

(6) Installation of Risers and Well Completions

The mobile workover rig 67 is used to run and tie back the production risers 48 and the christmas trees 50 and set same on the hull supports 79 (FIG. 11). The method comprises, for each well riser, the lifting by the deck crane 42 of riser pipe sections from a transport vessel means onto the deck upper level 115 and then the stacking of the riser sections vertically in the workover platform 67, which is positioned above a desired riser support 79 and then the workover platform is used to connect the riser sections and deploy vertically the assembled riser string down and through the support 79 until the riser is completely assembled, with the riser tension adjuster 80 (FIG. 5) installed on the riser and with christmas tree connected at its upper extremity. The complete production riser assembly is then lowered suspended from the workover platform 67 by an additional length of riser pipe and the lower extremity of the well riser is connected remotely to the wellhead, near the seabed, using conventional drilling practices and procedures. The threaded nut 119 (FIG. 5) is then rotated until it is positioned at the desired elevation with respect to the support 79 and the tie rod threaded nuts 118 are advanced up the rods until the riser tensioner 80 bears fully against the nut 119; the whole production riser is thus supported by the support 79 with a desired pretension load which is imparted by the tensioner 80 acting against the nut 119. All of the foregoing operations are repeated to install each of the production risers.

Figure 21:
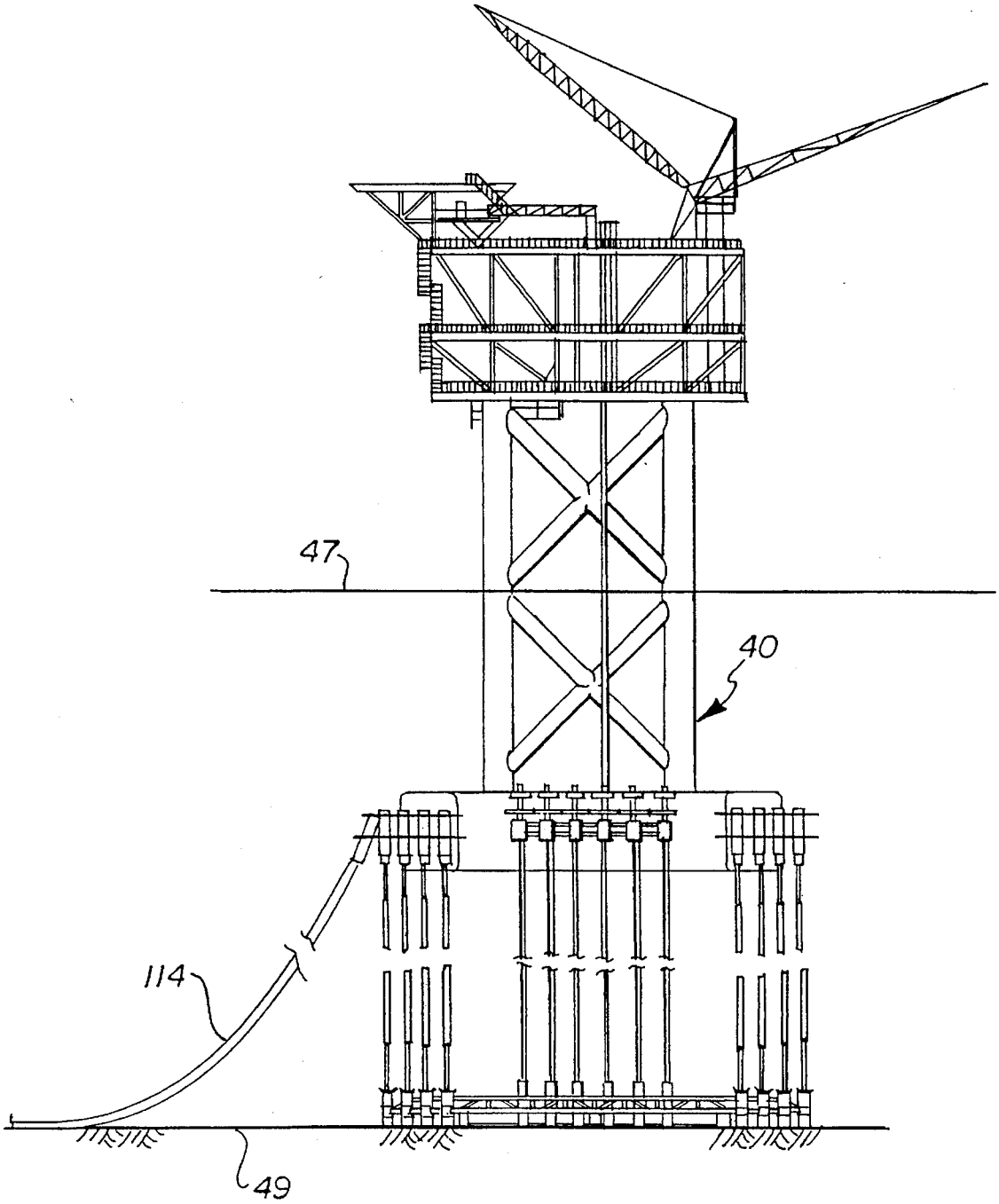
FIG. 21 is a side elevational view of the platform with a pipeline connected to it and through which platform products may be exported.

The platform is then completely ready to initiate production operations and bring the field onstream, once an offtake tanker barge 69 has been mobilized to site, moored up and connected to the platform, or when a pipeline 114 has been connected to the said platform (FIG. 21).

After reading and understanding the foregoing description of the invention, in conjunction with the drawings, it will be appreciated that there are several distinct advantages of the present platform and method of transportation and installation. It will further be appreciated that the present invention incorporates and combines novel ideas with existing practices and technology which are applied, in the context of the invention, in a new manner.

Without attempting to set forth all the desirable features of the present tension leg platform, at least some of the major advantages of the invention include the unique deck with skiddable workover structure which may be positioned at any location around the deck perimeter, the hull configuration which is buoyant and stable during all stages of installation yet at the same time presents minimum resistance to wave and current loadings, and minimizes the tendon tension loads and load variations.

Additionally, support of the risers at the base of the hull instead of at the deck level reduces the platform payload size and tendon anchor loadings, and furthermore permits the use of a novel riser support means. By minimizing the weight of the deck and hull using the foregoing means, the magnitude of the hull anchoring forces is correspondingly minimized, and consequently the size and weight and quantity of the tendons, anchor foundation piles is reduced.

Furthermore, the seabed template structure positions but does not support the installed anchor piles and production wells and its structural strength and weight is thus minimized.

It is an advantage that the tendons may be manufactured using conventional drilling industry materials and components in sections transported to site by a supply boat and assembled to form a whole tendon and installed by a conventional deepwater drilling vessel. Furthermore, it is an advantage that the lower extremity may be connected directly with no moving parts to the anchor pile and that the upper extremity of the tendon may be attached directly to a length of steel pipe which may be connected using cement grout to a hull sleeve pipe, and with no need for other means of adjusting the lengths of the tendons.

A further advantage of the invention is that an anchor pile may be connected to the tendon and the whole assembly deployed and installed by a deepwater drilling vessel.

Yet another advantage is that all the tendons may be connected to the foundations and that the hull may then be connected simultaneously to the tendons and that there is no requirement to adjust the tension loads in the tendons, the tension in each tendon being assured equal within limitations by the attachment to each tendon of temporary buoyancy of equal size and weight, and by the temporary gripper system employed for platform attachment operations.

It is an advantage to use tensioning lines connected to each of the tendons during the installation of the platform hull as previously mentioned. The tensioning lines enhance the stability of the hull during the phase when it is ballasted down and in particular the transition from large waterplane to small waterplane may cause the hull to be unstable without the tensioning lines, which by impeding only upward movement of the hull, do enhance the stability of the hull by causing a stabilizing moment to act upon the hull, the moment M being equal to:

$$M = \rho_w g \sum_{i=1}^{N} R_i^2 A_i \sin\phi$$

where:

i=index of column;

N=total number of columns;

$\phi$=angle of inclination;

$R_i$=radius from center of rotation to center of column i;

$\rho_w$=seawater density;

g=acceleration due to gravity;

$A_i$=waterplane area of column i.

It is an advantage that the deck may be lifted and installed as a single unit by a conventional cranevessel and that the cranevessel does not need to be moored by anchor mooring lines nor be equipped with a dynamic positioning system but may be moored to the hull and additionally controlled by tugboats.

A further advantage of the invention is that fluid products from the platform as well as being exported through a conventional pipeline may alternatively be exported to a tanker which may be moored to the platform.

While this invention has been described fully and completely with special emphasis on preferred embodiments and illustrated advantages, it should be understood that within the scope of the appended claims, the invention may be practiced otherwise than as specifically described herein.

What is claimed is:

1. An offshore tension leg platform comprising:

(a) a buoyant hull adapted at an upper end for supporting at least one deck above the water surface;

(b) structural support elements connected to said hull and containing tendon connection devices;

(c) at least one foundation element secured to the seabed;

(d) a plurality of elongate substantially vertical tendons each connected at a lower end to said at least one foundation element and at an upper end to said tendon connection devices to restrain said hull and substantially inhibit roll and pitch rotation of said hull about a horizontal axis;

(e) at least one deck supported at the upper end of said hull;

(f) riser support devices connected to said hull at substantially the same elevation as said tendon connection devices for supporting an upper end of substantially vertical risers at substantially the same elevation as the tendon connection to said hull, said risers having a lower end connected to wells on the seabed; and (g) at least one well workover structure movably mounted adjacent the periphery of said at least one deck to provide vertical access to the supported risers.

2. An offshore tension leg platform as defined in claim 1, wherein said hull upper end includes a plurality of columns having upper ends supporting said at least one deck.

3. An offshore tension leg platform as defined in claim 1 wherein said structural support elements extend laterally outward a predetermined distance from said hull and said tendon connection devices are secured at the outer ends of said structural support elements; and said tendons are disposed and connected to said tendon connection devices at locations that are spaced laterally outward a predetermined distance relative to the periphery of said hull.

4. An offshore tension leg platform as defined in claim 1, wherein said riser support devices include resilient support means to provide a resilient support between said risers and said hull.

5. An offshore tension leg platform as defined in claim 1, wherein said riser support devices include rigid support means to provide a rigid support between said risers and said hull.

6. An offshore tension leg platform as defined in claim 1 further comprising:

production equipment and facilities on said at least one deck for production operations and including mooring means for releasably connecting a tanker to said platform and a product export hose for pumping fluid products into the tanker for export from the platform.

7. An offshore tension leg platform as defined in claim 1 wherein said platform is connected by riser pipes to wells located on the seabed in laterally spaced relation to the position of said platform.

8. An offshore tension leg platform as defined in claim 1 further comprising:

well production trees disposed directly above said riser support devices and vertically accessable from said well workover structure when positioned thereabove, for well workover operations.

9. An offshore tension leg platform as defined in claim 8 further comprising:

a remotely moveable guideline device for guiding equipment including inspection tools, workover and access risers from said well workover structure onto said well production trees, without the requirement for divers.

10. An offshore tension leg platform as defined in claim 1 further comprising:

a support deck for supporting extension risers and well production trees;

well production trees supported on said support deck substantially above the water surface;

an extension riser connected at a bottom end to each said riser which is supported by said riser support devices and connected at a top end to each said well production tree; and said support deck providing vertical and lateral support to each said extension riser and said production trees.

11. An offshore tension leg platform comprising:

(a) A buoyant hull having an upper portion with at least one substantially vertically oriented column adapted at an upper end for supporting at least one deck above the water surface and a lower portion having two elongate horizontally oriented pontoon structures intersecting at approximately mid-span with axes at right angles to each other and each having a plurality of internal ballast compartments;

(b) structural support elements connected to said pontoon structures and tendon connection devices secured to said structural support elements;

(c) at least one foundation element secured to the seabed;

(d) a plurality of elongate substantially vertical tendons each connected at a lower end to said at least one foundation element and at an upper end to said tendon connection devices; and (e) at least one deck supported at the upper end of said said at least one column.

12. An offshore tension leg platform as defined in claim 11 wherein said hull upper portion has a plurality of said columns adapted at their upper ends for supporting said at least one deck.

13. An offshore tension leg platform as defined in claim 11 wherein said structural support elements extend laterally outward a predetermined distance from said pontoon structures and said tendon connection devices are secured at the outer ends of said structural support elements; and said tendons are disposed and connected to said tendon connection devices at locations that are spaced laterally outward a predetermined distance relative to the periphery of said pontoon structures.

14. An offshore tension leg platform as defined in claim 11 further comprising:

diagonal structural bracing members between said pontoon structures; and riser support devices on said bracing members for supporting an upper end of substantially vertical risers at substantially the same elevation as the tendon connection to said tendon connection devices, said risers having a lower end connected to wells on the seabed.

15. An offshore tension leg platform as defined in claim 11 wherein said platform is connected by riser pipes to wells located on the seabed in laterally spaced relation to the position of said platform.

16. An offshore tension leg platform as defined in claim 11 further comprising production equipment and facilities on said at least one deck for production operations and including mooring means for releasably connecting a tanker to said platform and a product export hose for pumping fluid products into the tanker for export from said platform.

17. An offshore tension leg platform comprising:

(a) a buoyant hull;

(b) a foundation element secured to the seabed;

(c) tendon connection sleeves attached to said hull in a substantially vertical orientation; and (d) a plurality of elongate substantially vertical tendons each connected at a lower end to said foundation element and having a vertically oriented extension at a top end which is received in a said tendon connection sleeve and grouted thereto.

18. An offshore tension leg platform comprising:

(a) a buoyant hull;

(b) a foundation element secured to the seabed;

(c) at least two tendon connection devices attached to said hull each having substantially vertically oriented tendon extensions; and (d) a plurality of elongate substantially vertical tendons each connected at a lower end to said foundation element having a vertically oriented sleeve portion at a top end in which a said tendon extension is received and grouted thereto.

19. An offshore tension leg platform comprising:

(a) a buoyant hull;

(b) structural support elements connected to said hull and tendon connection devices secured to said structural support elements;

(c) foundation elements secured to the seabed; and (d) a plurality of elongate substantially vertical tendons each connected at a top end to a said tendon connection device, and each having an extension device at a bottom end adapted for connection to a said foundation element by means of a grouted connection.

20. An offshore tension leg platform as defined in claim 19 wherein said foundation elements comprise piles secured to the seabed, and said extension device at the bottom end of each said tendon is adapted for connection to a said pile by means of a grouted connection.

21. An offshore tension leg platform comprising:

(a) a buoyant hull;

(b) structural support elements connected to said hull and tendon connection devices secured to said structural support elements;

(c) foundation elements secured to the seabed; and (d) a plurality of elongate substantially vertical tendons each connected at a top end to each said tendon connection device and at a bottom end to a said foundation element, and each said tendon having a stress joint located at at least one end to allow said tendons to articulate in any direction.

22. An offshore tension leg platform as defined in claim 21 wherein said foundation elements comprise piles, and each of said tendons is connected to a top end of a said pile.

23. An offshore tension leg platform as defined in claim 21 wherein each of said tendons comprise segmented tubular members joined mechanically and each member is non-flooding.

24. A method of installing an offshore tension leg platform comprising the steps of:

(a) connecting the lower ends of elongate tubular tendons to a foundation on the seabed, and supporting the top of the tendons with buoyancy elements;

(b) transporting a said tension leg platform hull to the installation site;

(c) temporarily installing gripper devices on said hull and installing winch means on top of said platform;

(d) connecting tensioning wires to the upper portions of each of said tendons and securing said wires through said gripper means to said winch means, whereby said gripper means permits downward travel of said hull relative to said tensioning wires but prevents upward movement of said hull;

(e) operating said winch means to apply nominal tension in said tensioning wires;

(f) progressively ballasting said platform hull and allowing said tensioning wires to travel upward through said tendon connection sleeves until all motions relative to said tendons have been arrested and said platform hull is at a desired draft;

(g) securing the upper ends of said tendons to hull;

(h) adjusting the ballast of said platform hull to set a desired tension in the tendons.

25. A method of transporting a non-floating structure from land to an offshore location for installation on the seabed comprising the steps of:

(a) connecting lines to said non-floating structure and connecting the free end of said lines to flotation devices;

(b) suspending said non-floating structure beneath a conventional cargo barge and placing said floatation devices on the barge;

(c) towing the barge with said non-floating structure suspended there beneath to a location of sufficient water depth to avoid grounding said non-floating structure when suspended from said flotation devices by said line;

(d) releasing said flotation devices into the water and releasing said structure from the barge such that said non-floating structure is suspended from said flotation devices;

(e) maneuvering the barge clear of said flotation devices; and (f) towing said flotation devices and said non-floating structure suspended therefrom to the installation site.

26. The method according to claim 25 in which said non-floating structure is to be positioned beneath a semisubmersible drilling vessel rig, and including the further steps of:

(a) connecting maneuvering lines from said semisubmersible drilling vessel rig to said flotation devices;

(b) deballasting said semisubmersible vessel drilling rig up onto its hull pontoons;

(c) floating said flotation devices and said non-floating structure suspended therefrom under said semisubmersible drill vessel rig;

(d) connecting a riser or drillpipe between said semisubmersible drilling vessel rig and said non-floating structure and taking up the payload of said non-floating structure on the riser or drillpipe;

(e) releasing said flotation devices and maneuvering them clear of said non-floating structure;

(f) sequentially assembling riser or drill string and lowering said non-floating structure onto the seabed beneath said semisubmersible drilling vessel rig; and thereafter (g) anchoring said non-floating structure to the seabed.

27. A means of enhancing the stability of a floating hull during the temporary phase of increasing the draft of said hull from towage draft to final draft whereby tensioning lines are connected at or near the extremities of said hull through gripper devices and said tensioning lines are connected at the bottom to the seabed or to another device that is secured to the seabed, whereby said tension lines prevent upward movement of the hull, and thereby induces a stabilizing moment if one side of said hull tips downward, causing additional hull volume to submerge, said stabilizing moment being approximately proportional to the amount of hull volume that has incrementally submerged due to tipping, and proportional and the square of the horizontal distance between the centroid of the said incremental volume and the point of rotation at the gripper means.

28. A method of drilling one or more subsea wells after an offshore tension leg platform has been installed at site, comprising the steps of:

(a) placing one or more anchoring means on the seabed, and connecting said anchoring means to said tension leg platform;

(b) pulling said platform by said anchor means causing said platform to offset a distance away from the location of the well to be drilled;

(c) positioning a mobile offshore drilling rig over the well location, and drilling the well using said rig's drilling systems;

(d) removal of said mobile offshore drilling rig after well drilling is complete;

(e) return of the said platform to its normal position by releasing the attachment of the said anchor means to said platform.

29. The method of claim 28, and in which the required force to offset the tension leg platform is reduced by reducing the tension in the said platform tendons by ballasting said tension leg platform, or by adding weight to said platform, or both.

* * * * *